US007057483B2

(12) United States Patent
Enokihara et al.

(10) Patent No.: US 7,057,483 B2
(45) Date of Patent: Jun. 6, 2006

(54) HIGH-FREQUENCY CIRCUIT DEVICE AND HIGH-FREQUENCY CIRCUIT MODULE

(75) Inventors: Akira Enokihara, Nara (JP); Hideki Namba, Kyoto (JP); Toshiaki Nakamura, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/186,109

(22) Filed: Jul. 21, 2005

(65) Prior Publication Data

US 2005/0253672 A1 Nov. 17, 2005

Related U.S. Application Data

(62) Division of application No. 10/466,508, filed as application No. PCT/JP02/00372 on Jan. 21, 2002, now Pat. No. 6,954,124.

(30) Foreign Application Priority Data

Jan. 19, 2001 (JP) ..... 2001-011244
Jun. 12, 2001 (JP) ..... 2001-176603

(51) Int. Cl.
*H01P 7/10* (2006.01)
*H01H 5/12* (2006.01)

(52) U.S. Cl. ..... 333/219.1; 333/134

(58) Field of Classification Search ..... 333/219.1, 333/202, 204, 134
See application file for complete search history.

(56) References Cited

U.S. PATENT DOCUMENTS 4,318,064 A 3/1982 Kach
4,477,785 A 10/1984 Atia
5,324,713 A 6/1994 Shen
6,184,758 B1 * 2/2001 Ishikawa et al. ..... 333/134
6,236,291 B1 5/2001 Sonoda et al.

(Continued)

FOREIGN PATENT DOCUMENTS

JP 60-145705 8/1985

(Continued)

OTHER PUBLICATIONS

Microfilm of the specification and drawings annexed to the request of Japanese Utility model Application No. 111546/1988 (Laid-open No. 32213/1990) (Murata Mfg. Co., Ltd.), Feb. 28, 1990, p. 9, line 6 to p. 10, line 10; Fig. 6 (Family: none).

(Continued)

*Primary Examiner*—James H. Cho

(74) *Attorney, Agent, or Firm*—Harness, Dickey & Pierce, P.L.C.

(57) ABSTRACT

A high-frequency circuit device includes a dielectric member 1, a shielding conductor 2 surrounding the dielectric member 1, a support member 3 for fixing and supporting the dielectric member 1, and a pair of transmission lines 4 each of which is formed of a microstrip-line. Each of the transmission lines includes a substrate 6 formed of a dielectric material, a strip conductor 5, and an earth conductor layer 9. An end portion of the strip conductor 5 faces part of the dielectric member 1 and functions as a coupling probe for input/output coupling. Each of the transmission lines 4 is formed of a strip line, a mictostrip line, a coplanar line or the like, and has low-loss when connected to a circuit board.

3 Claims, 27 Drawing Sheets

U.S. PATENT DOCUMENTS

| | | | | |
|---|---|---|---|---|
| 6,249,195 | B1 * | 6/2001 | Mikami et al. | 333/134 |
| 6,388,541 | B1 | 5/2002 | Hiratsuka et al. | |

FOREIGN PATENT DOCUMENTS

| | | | |
|---|---|---|---|
| JP | 62-53754 | | 10/1988 |
| JP | 01208001 | | 8/1989 |
| JP | 02108001 | A | 8/1989 |
| JP | 2-49318 | | 1/1992 |
| JP | 5-110304 | | 4/1993 |
| JP | 05167306 | A | 7/1993 |
| JP | 5-304401 | | 11/1993 |
| JP | 10-163704 | | 6/1998 |
| JP | 10-284946 | | 10/1998 |
| JP | 11004108 | A | 1/1999 |
| JP | 11-145703 | | 5/1999 |
| JP | 2000-124701 | | 4/2000 |

OTHER PUBLICATIONS

Microfilm of the specification and drawings annexed to the request of Japanese Utility model Application No. 49318/1990 (Laid-open No. 8501/1992) (Murata Mfg. Co., Ltd.), Jan., 27, 1992, p. 1., line 17 to p. 2, line 8; Figs. 5 to 6 (Family: none).

Microfilm of the specification and drawings annexed to the request of Japanese Utility model Application No. 53754/1987 (Laid-open No. 159901/1988) (Mitsubishi Electric Corp.), Oct., 19, 1988, p. 4, line 12 to p. 5, line 8; Fig. 1 (Family: none).

* cited by examiner

| Dielectric ceramic material | | Size at 26GHz [mm] | | No load Q value (actually measured) |
|---|---|---|---|---|
| Name of material | Properties | Dielectric resonator | Cross section of shield conductor | |
| Zr-Ti-O$_4$ | $\varepsilon_r$ = 42.5<br>fQ=44000[GHz] | 1×1×4.2 | 2×2 | 1000 |
| MgTiO$_3$<br>CaTiO$_3$ | $\varepsilon_r$ = 21<br>fQ=70000[GHz] | 1×1×5.6 | 3×3 | 2000 |
| Ba(Mg, Ta)O$_3$ | $\varepsilon_r$ = 24<br>fQ=120000[GHz] | 1×1×5.1 | 3×3 | 2600 |

Substrate
5
6
9
9'

HIGH-FREQUENCY CIRCUIT DEVICE AND HIGH-FREQUENCY CIRCUIT MODULE

CROSS-REFERENCE TO RELATED APPLICATIONS

This application is a divisional of U.S. patent application Ser. No. 10/466,508 filed on Jul. 17, 2003, now U.S. Pat. No. 6,954,124 which is a National Phase of PCT/JP02/00372 filed Jan. 21, 2002. This application also claims the benefit of Japanese Patent Application Nos. 2001-011244 filed Jan. 19, 2001 and 2001-176603 filed Jun. 12, 2001. The disclosure(s) of the above application(s) are incorporated herein by reference.

TECHNICAL FIELD

The present invention relates to high-frequency circuit devices and modules for resonance used in radio-communication systems or other devices dealing with high-frequency signals.

BACKGROUND ART

Conventionally, high-frequency filters and other high-frequency circuit devices including a resonant body as a basic element are essential for communication systems. With a resonant body, among resonator bodies, using a dielectric material such as a high dielectric constant, low-loss ceramic material, a high-frequency circuit device functioning as a small and low-loss (high-Q) resonator can be achieved.

Such a resonator can be disposed with other circuit elements such as an amplifier, an oscillator, and a mixer circuit on a substrate to make a high-frequency circuit have a module configuration. In this case, a high-frequency signal needs to be input/output to/from the resonator via a transmission line such as a stripline on the substrate. As an example of such high-frequency circuits using a dielectric material, a circuit in which a dielectric member is disposed on a circuit board and then a stripline around the member and thereby a high-frequency signal is input/output from/to a resonator is known, as disclosed, e.g., in Japanese Unexamined Patent Publication 10-284946.

In this case, the dielectric member has a circular cross section and resonates in the $TE_{01\delta}$ mode. The dielectric member is used for the purpose of transmitting only a desired frequency element of a high-frequency signal from the stripline, or removing unnecessary frequency elements.

Problems to be Solved

However, the above-described known high-frequency circuit in which a dielectric member is disposed on a substrate has the following problems.

First, since the dielectric member is used without being shielded, high-frequency signals (electromagnetic waves) from the dielectric member are emitted. The signal emission may cause an increase in the loss of a resonator, i.e., a reduction in the Q value of the resonator. Moreover, by the emitted electromagnetic waves, the dielectric member may be coupled with other circuits disposed on a substrate to make circuit operation unstable. Furthermore, in order to suppress the coupling between the dielectric member and other circuits by the emitted electromagnetic waves, it is necessary to dispose the dielectric member so as to be spaced apart from the other circuits by a certain distance. This is an obstacle to reduce the size of an entire module.

The above-described problems are more clearly noticed, as the frequency of high-frequency signals dealt with in a high-frequency circuit device is increased. Therefore, they may be fatal problems in a millimeter wave band or the like.

Moreover, in a $TE_{01\delta}$ mode resonator, the distribution of the resonant electric field may show a concentric configuration in a cylindrical dielectric member. Therefore, it may be difficult to obtain a desired coupling of the dielectric member with a stripline or the like disposed on the substrate.

DISCLOSURE OF INVENTION

It is therefore an object of the present invention to provide low-loss, high-frequency circuit device and module in which a dielectric member is incorporated.

A high-frequency circuit device according to the present invention includes: at least a dielectric member which can create a resonant state of an electromagnetic wave; a shielding conductor surrounding the dielectric member; at least a transmission line including a strip conductor disposed to face part of the dielectric member, an earth conductor layer disposed to face the strip conductor, and a dielectric layer interposed between the strip conductor and the earth conductor layer; and a coupling probe which is connected to the transmission line and has the input/output coupling function of input/output coupling with the dielectric member by an electromagnetic wave.

Thus, the dielectric member is surrounded by the shielding member. Accordingly, emission of an electromagnetic wave from the dielectric member to the outside thereof is blocked and also it is possible due to the structure of the transmission lines to make smooth connection with other semiconductor devices or the like in the high-frequency circuit. That is to say, functions which have been achieved with a waveguide or the like can be attained on a circuit board. Therefore, the size of an entire high-frequency circuit which has low-loss, i.e., a large Q value and in which a high-frequency circuit device is disposed can be reduced.

The dielectric member is excited in a TM mode. Therefore, in a TM mode resonator, the electric field extends along the longitudinal direction of the dielectric member and thus the dielectric member can be coupled with the strip conductor of each said transmission line in a simple manner. Accordingly, each said transmission line having the strip conductor can be used for the input/output. Therefore, by disposing the transmission lines with the high-frequency circuit on a substrate, the transmission lines can be applied to a high-frequency circuit having a module configuration in an easy manner.

The transmission line preferably includes at least one of a stripline, a microstrip-line, a coplanar line and a microwire line.

If the inventive high-frequency circuit device further includes within the shielding conductor an insulating layer which is filled in the space between the shielding conductor and the dielectric member and supports the dielectric member, a stable resonance state of the dielectric member can be achieved.

If the shielding conductor is formed of a conductive coating film on the outside surface of the insulating layer, the strip conductor is formed of the conductive coating film so as to be separated from the shielding conductor, and part of the conductive coating film facing the strip conductor functions as the earth conductor layer, process steps for fabricating the high-frequency circuit device can be simplified and production costs can be reduced.

The earth conductor layer may form a wall portion that is to be part of the shielding conductor, and the high-frequency circuit device may further includes a groove formed in the earth conductor layer and an insulating support substrate which is formed on the earth conductor layer so as to be located over the groove and supports the dielectric member.

Said at least a transmission line may be a pair of transmission lines and the high-frequency circuit device may function as a bandpass filter.

In that case, an end portion of the strip conductor may extend so as to protrude outward from the dielectric layer and function as the coupling probe, or the end portion of the strip conductor may be located on the dielectric layer and function as the coupling probe.

The end portion of the strip conductor is preferably bent in the direction in which the degree of input/output coupling is increased.

Specifically, when a main portion of the strip conductor extends perpendicularly to the longitudinal direction of the dielectric member, the part of the strip conductor preferably extends almost in parallel to the longitudinal direction of the dielectric member.

Said at least a transmission line may be a continuous line and the high-frequency circuit device functions as a band stop filter.

In that case, part of the strip conductor other than the end portion faces the dielectric member and functions as the coupling probe.

The part of the strip conductor is preferably bent in the direction in which the degree of input/output coupling is increased.

Specifically, when a main portion of the strip conductor extends perpendicularly to the longitudinal direction of the dielectric member, the part of the strip conductor preferably extends almost in parallel to the longitudinal direction of the dielectric member.

If the inventive high-frequency circuit device further includes: a dielectric substrate; and a first conductive film which is formed on a surface of the dielectric substrate facing the dielectric member and is to be part of the shielding conductor, process steps for fabricating the high-frequency circuit device can be simplified.

The dielectric member is, e.g., a square pole or a circular cylinder.

The shape of the dielectric member's cross section perpendicular to the longitudinal direction thereof changes so that the cross section has the largest area at a center portion of the dielectric member. Thus, the size of the high-frequency circuit device can be reduced.

Said at least a dielectric member may be a plurality of dielectric members coupled with each other.

If the inventive high-frequency circuit device further includes a frequency adjustment screw which is inserted through the shielding conductor into a region of the high-frequency circuit device surrounded by the shielding conductor and has an end facing the dielectric member, frequency properties can be more finely adjusted.

When said at least a dielectric member is a plurality of dielectric members coupled with each other, the high-frequency circuit device further includes an inter-stage coupling adjustment screw which is inserted through the shielding conductor into a region of the high-frequency circuit device surrounded by the shielding conductor and has an end facing the space between adjacent ones of the dielectric members. Thus, an inter-stage coupling state can be more finely adjusted.

A high-frequency circuit module according to the present invention includes: a plurality of high-frequency circuit devices; and a phase shift circuit provided between adjacent ones of the plurality of the high-frequency circuits, each said high-frequency circuit device includes: at least a dielectric member which can create a resonant state of an electromagnetic wave; a shielding conductor surrounding the dielectric member; at least a transmission line including a strip conductor disposed to face part of the dielectric member, an earth conductor layer disposed to face the strip conductor, and a dielectric layer interposed between the strip conductor and the earth conductor layer; and a coupling probe which is connected to the transmission line and has the input/output coupling function of input/output coupling with the dielectric member by an electromagnetic wave, and the transmission line of each said high-frequency circuit device is connected to the phase shift circuit.

Thus, a small-size, low-loss resonator (which multiplexes or separates transmission/reception signals having different frequencies) can be achieved. Thus, functions which have been achieved with a waveguide or the like can be attained on a circuit board.

When the respective center frequencies of the plurality of high-frequency circuit devices in a resonant state are different to each other, the high-frequency circuit module can perform processing.

For example, when the phase shift circuit is connected to an antenna, it is possible to simultaneously transmit and receive signals by utilizing the plurality of high-frequency circuit devices.

BEST MODE FOR CARRYING OUT THE INVENTION

FIRST EMBODIMENT

Figure 1A:
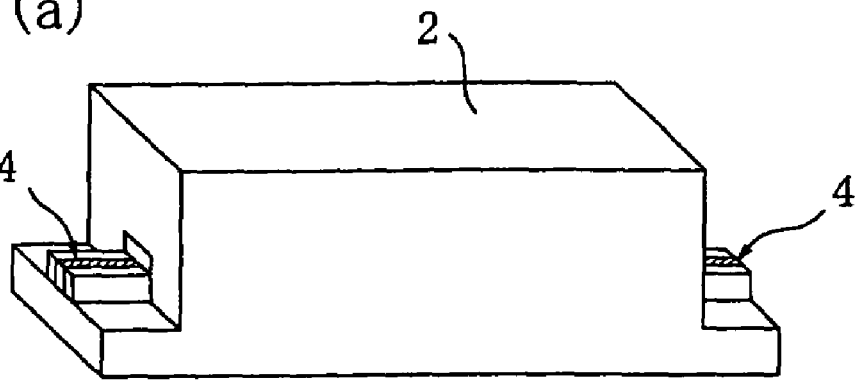
FIGS. 1(*a*), 1(*b*) and 1(*c*) are perspective, vertical-sectional, and cross-sectional views of a high-frequency circuit device according to a first embodiment of the present invention, respectively.
Figure 1B:
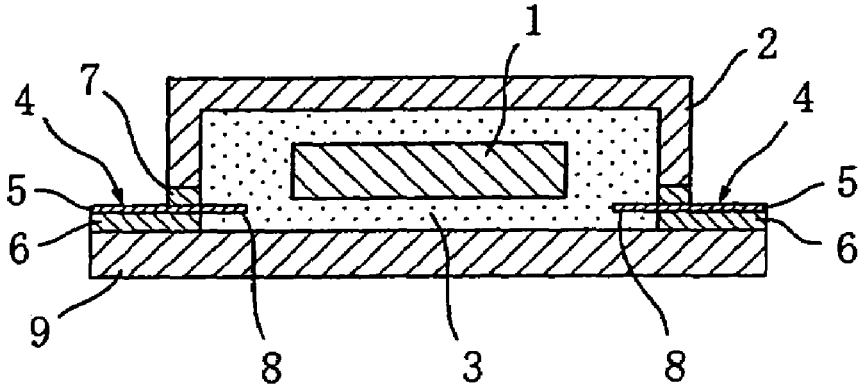
Figure 1C:
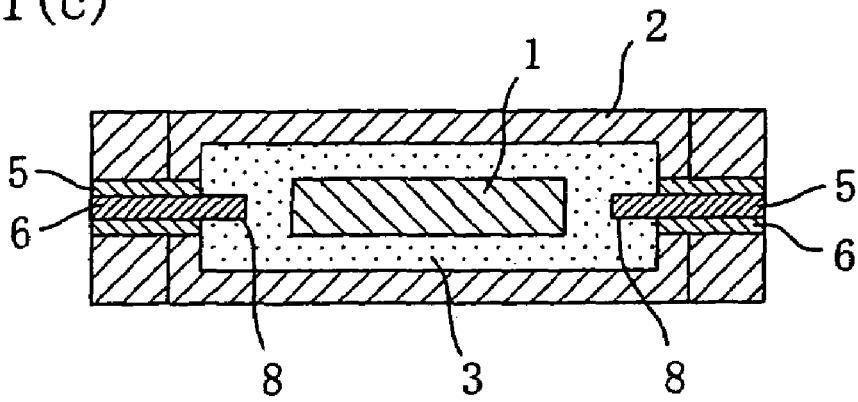

FIGS. 1(*a*), 1(*b*) and 1(*c*) are perspective, vertical-sectional, and cross-sectional views of a high-frequency circuit device according to a first embodiment of the present invention, respectively. As shown in FIGS. 1(*a*) through 1(*c*), the high-frequency circuit device includes a dielectric member 1 which is formed of a ceramic material or the like such as a material containing, e.g., $ZrO_2$—$TiO_2$—$MgNb_2O_6$ as a main component and has a square pole shape, a shielding conductor 2 which is formed of a zinc-copper alloy or the like, surrounds the dielectric member 1 and has gold-plated inside walls, a support member 3 which fixes and supports the dielectric member 1 and is formed of polytetrafluoroethylene resin or the like, and a pair of transmission lines 4 formed of a microstrip-line. Each of the transmission lines 4 functions as an input line or an output line according to the direction in which a high-frequency signal is transmitted.

Moreover, each of the transmission lines 4 includes a transmission-line substrate 6 formed of polytetrafluoroethylene resin or the like, a strip conductor 5 formed of a silver ribbon or the like on the upper surface of the transmission-line substrate 6, and an earth conductor layer 9 for supporting the transmission-line substrate 6 at the underside surface. The earth conductor layer 9 is formed of part of the shielding conductor 2. Each of the transmission lines 4 is inserted into a region of the high-frequency circuit device surrounded by the shielding conductor through part of the shielding conductor 2. More specifically, a window is formed in part of a side wall of the shielding conductor 2 perpendicular to the longitudinal direction of the shielding conductor 2, each of the transmission lines 4 is inserted into the window and the upper surface of each of the transmission lines 4 is covered with an insulator 7 at a window portion. The insulator 7 is provided to prevent a short-circuit of the strip conductor 5 to the shielding conductor 2. In the shielding conductor 2, an end portion of each of the strip conductor 5 protrudes outward from the insulator substrate 6 and faces the side surface perpendicular to the longitudinal direction of the dielectric member 1 so as to form a coupling probe portion 8. The coupling probe portion 8 exhibits the input coupling function or the output coupling function, with respect to the dielectric member 1, according to the direction in which a high-frequency signal is transmitted.

Note that although not shown in the drawings, in this embodiment or other embodiments which will be described later, the transmission lines 4 are connected to various circuits (e.g., an amplifier, a voice converter circuit, and an image converter circuit) disposed on a circuit board.

In this embodiment, the earth conductor layer 9, which is also part of the shielding conductor 2, serves as a ground plane of the transmission lines 4. Therefore, to connect each of the transmission lines 4 and an external circuit to each other, only application of a signal voltage between the strip conductor 5 and the earth conductor layer 9 is required. Thus, it is possible to suppress signal loss to a lower level.

In the structure of the high-frequency circuit device of this embodiment, it is possible to make the dielectric member 1 resonate in a resonator mode called "$TM_{11\delta}$ mode" for a resonator with a rectangular cross section by appropriately selecting shapes and materials for the dielectric member 1, the shielding conductor 2 and the support member 3. Thus, with the high-frequency circuit device of this embodiment, a $TM_{11\delta}$ mode resonator can be achieved. Also, the high-frequency circuit device of this embodiment can be used as a single-stage bandpass filter.

In this case, the $TM_{11\delta}$ mode of the resonator with a rectangular cross section using dielectric member having a rectangular cross section is equivalent to the $TM_{11\delta}$ mode of the resonator with a circular cross section using a cylindrical dielectric member. In the resonator with a rectangular cross section, the first two subscrips of a mode name (i.e., 11 or 01 herein) are determined based on the periodicities of the magnetic fields in the directions in which the sides of the rectangular cross section of the resonator extend. In contrast, in the resonator with a circular cross section, the subscrips are determined based on the periodicities of the magnetic fields in the circumferential direction and in the radial direction.

SECOND EMBODIMENT

Figure 2A:
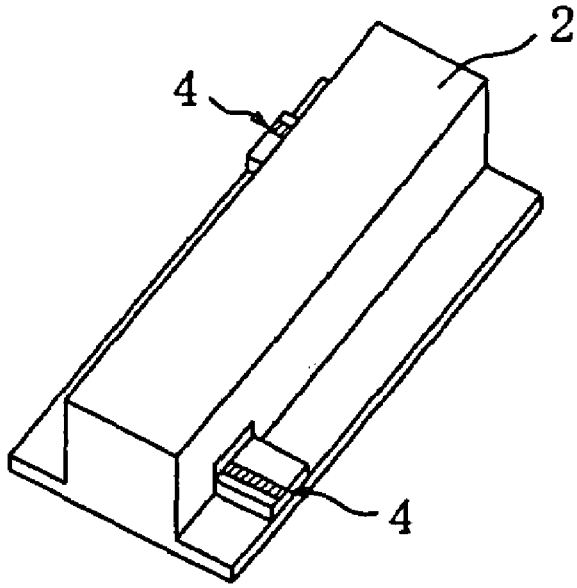
FIGS. 2(*a*) and 2(*b*) are perspective and cross-sectional views of a high-frequency circuit device according to a second embodiment of the present invention, respectively.
Figure 2B:
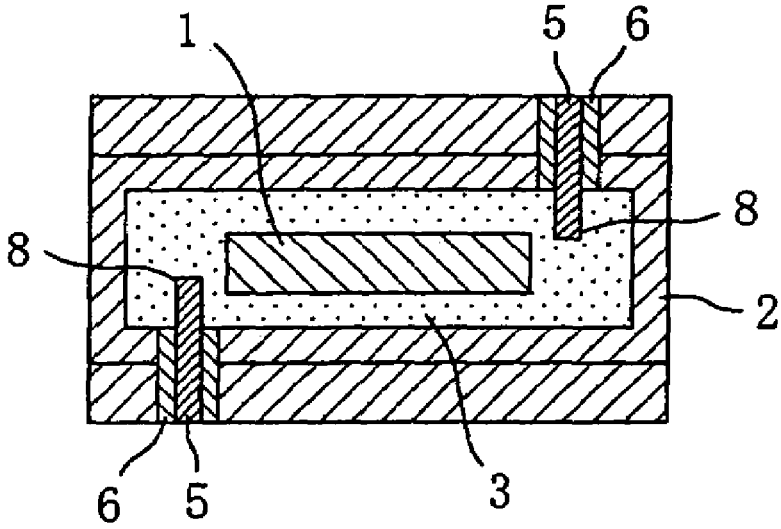

FIGS. 2(*a*) and 2(*b*) are perspective and cross-sectional views of a high-frequency circuit device according to a second embodiment of the present invention, respectively. As shown in FIGS. 2(*a*) and 2(*b*), in the high-frequency circuit device of this embodiment, a window is formed in a part of a longer side wall of a shielding conductor 2 and each of a pair of transmission lines 4 is inserted into the window, unlike the first embodiment. Then, the side surfaces of a coupling probe portion 8 of a strip conductor 5 face side surfaces of the dielectric member 1 perpendicular to the longitudinal direction of the dielectric member 1. The structure for other parts and resulting effects are basically the same as those of the first embodiment.

Note that as shown in FIG. 2(*b*), the pair of transmission lines 4 does not have to be inserted separately to the longer side walls of the shielding conductor 2 which are facing each other. Even if the transmission lines 4 are inserted to a single side wall, the same effects as those of this embodiment can be achieved.

SPECIFIC EXAMPLE OF SECOND EMBODIMENT

A high-frequency circuit device having the structure shown in FIGS. 2(*a*) and 2(*b*) has been formed in the following manner. As a dielectric member 1, a dielectric ceramic square pole (formed of a material containing $ZrO_2$—$TiO_2$—$MgNb_2O_6$ as a main component, and having a relative dielectric constant of 42.2 and a fQ value of 43000 GHz) which has dimensions of 1×1×4 mm is prepared and then the dielectric member 1 is fixed in a shielding conductor 2 formed of a zinc-copper alloy and having inside walls plated with gold. The dimensions of inside of the shielding conductor 2 are 2×2×10 mm. In this case, polytetrafluoroethylene resin is used as a support member 3 to be filled in the space between the shielding conductor 2 and the dielectric member 1. As for transmission lines 4, a strip conductor 5 of a silver ribbon (having a thickness of 0.1 mm and a width of about 1 mm) is formed on a transmission-line substrate 6 made of polytetrafluoroethylene resin. Then, the strip conductor 5 is extended so as to be protruded out further from the insulator substrate 6 and reach the inside of the shielding conductor 2. This extended portion is to be a coupling probe 8.

Figure 3:
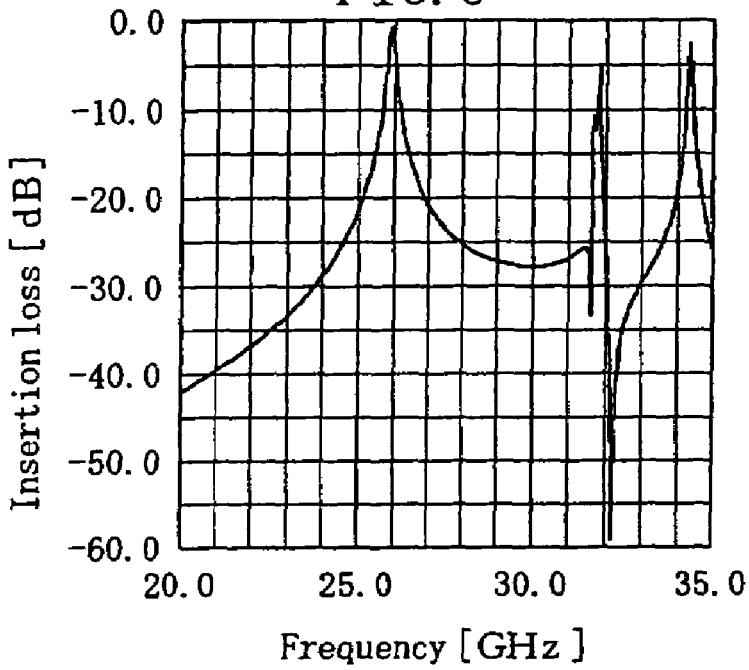
FIG. 3 is a graph showing frequency characteristics (permeation properties) with respect to insertion loss for a high-frequency circuit device of this specific example obtained from a simulation using electromagnetic analysis.

FIG. 3 is a graph showing frequency characteristics (permeation properties) with respect to insertion loss for a high-frequency circuit device of this specific example obtained from a simulation using electromagnetic analysis. FIG. 3 shows that a fundamental resonator mode appears at about 24 GHz. An analysis of the distribution of the electric field indicated that this mode was the $TM_{11\delta}$ mode, and thus it has been confirmed the high-frequency circuit device operates as a resonant circuit (resonator).

Figure 4:
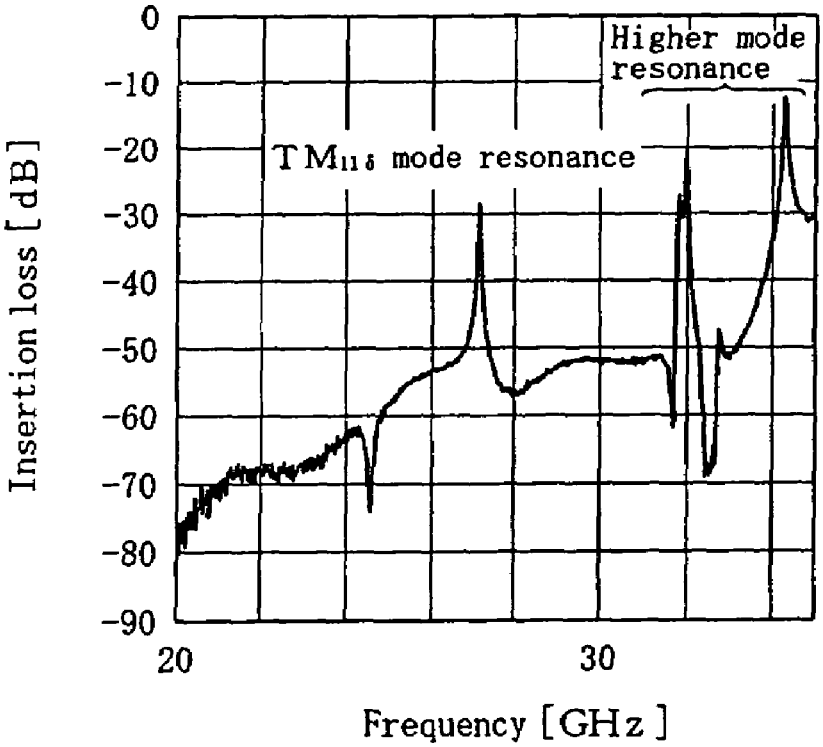
FIG. 4 is a graph showing actually measured data for frequency characteristics with respect to insertion loss for a prototype high-frequency circuit device of this specific example.

FIG. 4 is a graph showing actually measured data for frequency characteristics with respect to insertion loss for a prototype high-frequency circuit device of this specific example. Data shown in FIG. 4, including data for a higher resonator mode, agree very much with results obtained from the simulation using the electromagnetic analysis shown in FIG. 3. The actually measured no-load Q value was 870. It was measured in the following manner. Part of the graph of FIG. 4 around the peak of the $TM_{11\delta}$ was enlarged and then frequency f0 and insertion loss L0 (dB) at the peak, and frequencies f1, f2 at which the loss is L0+3 (dB) at the both sides of the peak were measured. Obtained values were then substituted for the following equation:

$$Qu=\{f0/|f1-f2|\}[1/\{1-10^{-L0/20}\}]$$

In this manner, the no-load Q value was obtained.

Moreover, it has been confirmed that the actually measured value for the no-load Q value (Qu) when the ceramic material of this specific example is used can be improved so as to reach about 1000 by finely adjusting the structure of the high-frequency circuit device.

As will be described later, it has been also confirmed that with some other low-loss ceramic material, the no-load Q value is improved.

Considering that the Q value of a half wavelength resonator using a general microstrip-line is about 100, the actually measured no-load Q values are very high and thus it is shown that with the high-frequency circuit device of this embodiment, a very-low-loss resonant circuit can be formed. In particular, if the high-frequency circuit device of this embodiment is applied to a circuit element such as a resonator or a filter in a millimeter wave band, higher effects can be achieved.

Note that this specific example is an example for the structure of the second embodiment. However, even though this example is used for the structure of the first embodiment, almost the same results can be obtained.

THIRD EMBODIMENT

Figure 5:
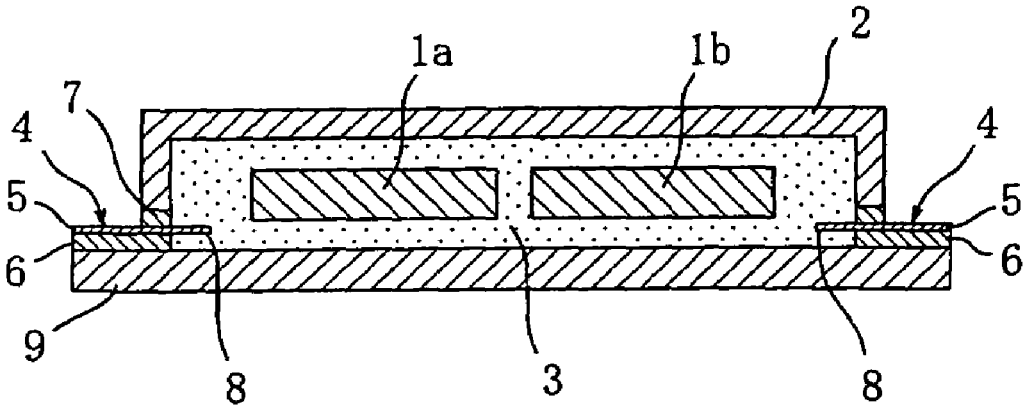
FIG. 5 is a vertical-sectional view of a high-frequency circuit device according to a third embodiment of the present invention.

FIG. 5 is a vertical-sectional view of a high-frequency circuit device according to a third embodiment of the present invention. As shown in FIG. 5, the high-frequency circuit device of this embodiment includes a shielding conductor 2 in which two dielectric members 1*a*, 1*b* are disposed in series in the longitudinal direction so as to be located at almost the same height. Other parts of the basic structure of the circuit are basically the same as those of the high-frequency circuit device of the first embodiment shown in FIG. 1.

The high-frequency circuit device of this embodiment can function as a low-loss, two-stage bandpass filter, as has been confirmed in a specific example which will be descried hereinafter.

SPECIFIC EXAMPLE OF THIRD EMBODIMENT

A high-frequency circuit device having the structure shown in FIG. 5 has been formed in the following manner. As dielectric members 1*a*, 1*b*, two dielectric ceramic square poles (formed of a material containing $ZrO_2$—$TiO_2$—$MgNb_2O_6$ as a main component and having a relative dielectric constant of 42.2 and a fQ value of 43000 GHz) which has dimensions of 1×1×4 mm are prepared. Then, the dielectric members 1*a*, 1*b* are fixed in a shielding conductor 2 formed of a zinc-copper alloy and having inside walls plated with gold. The dimensions of inside of the shielding conductor 2 are 2×2×12 mm. In this case, polytetrafluoroethylene resin is used as a support member 3 to be filled in the space between the shielding conductor 2 and each of the dielectric members 1*a*, 1*b*. As for transmission lines 4, a strip conductor 5 of a silver ribbon (having a thickness of 0.1 mm and a width of about 1 mm) is formed on a transmission-line substrate 6 made of polytetrafluoroethylene resin. Then, the strip conductor 5 is extended so as to protrude outward from the insulator substrate 6 and reach the inside of the shielding conductor 2. This extended portion is to be a coupling probe 8.

Figure 6:
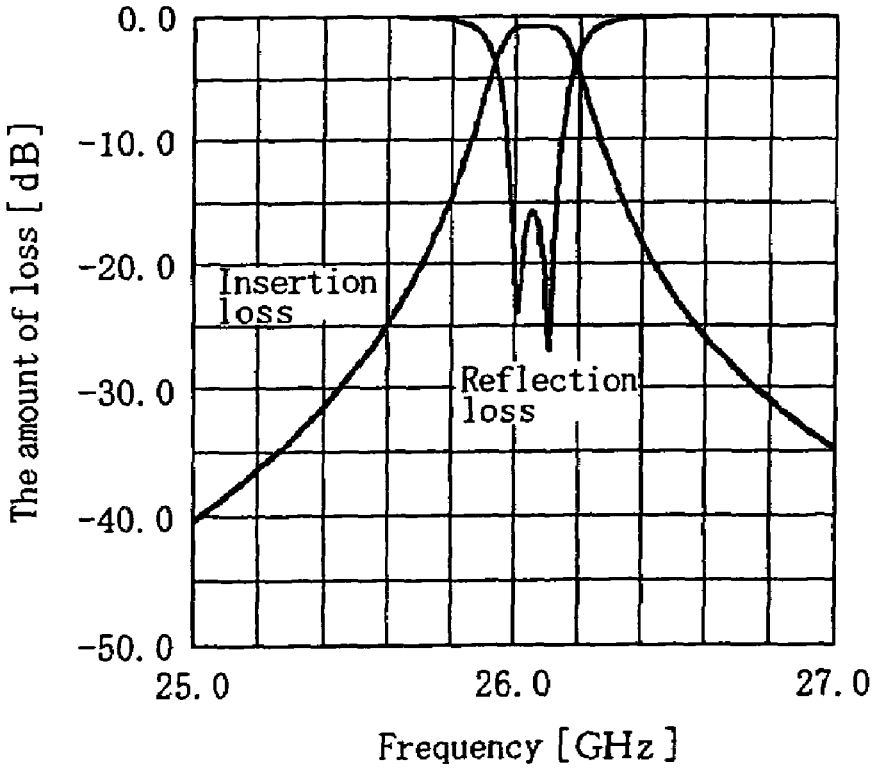
FIG. 6 is a graph showing frequency characteristics (permeation properties) with respect to insertion loss for a high-frequency circuit device of this specific example of the third embodiment obtained from a simulation using electromagnetic analysis.

FIG. 6 is a graph showing frequency characteristics (permeation properties) with respect to insertion loss for a high-frequency circuit device of this specific example of the third embodiment obtained from a simulation using electromagnetic analysis. It has been confirmed from FIG. 6 that the high-frequency circuit device of this specific sample (i.e., the third embodiment) can function as a two-stage bandpass filter.

In the structure of the high-frequency circuit device of this embodiment, as in the high-frequency circuit device of the second embodiment (see FIG. 2), a window may be formed in part of a longer side wall of the shielding conductor 2, each of the transmission lines 4 may be inserted into the window, and then the side surfaces of a coupling probe portion 8 of the strip conductor 5 may face a side surface of the dielectric member 1 perpendicular to the longitudinal direction of the dielectric member 1. Thus, almost the same effects as those of this embodiment can be attained.

Note that instead of the two dielectric members of this embodiment, three or more dielectric members can be disposed. That is to say, the high-frequency circuit device can be utilized as a multi-stage bandpass filter.

FOURTH EMBODIMENT

Figure 7A:
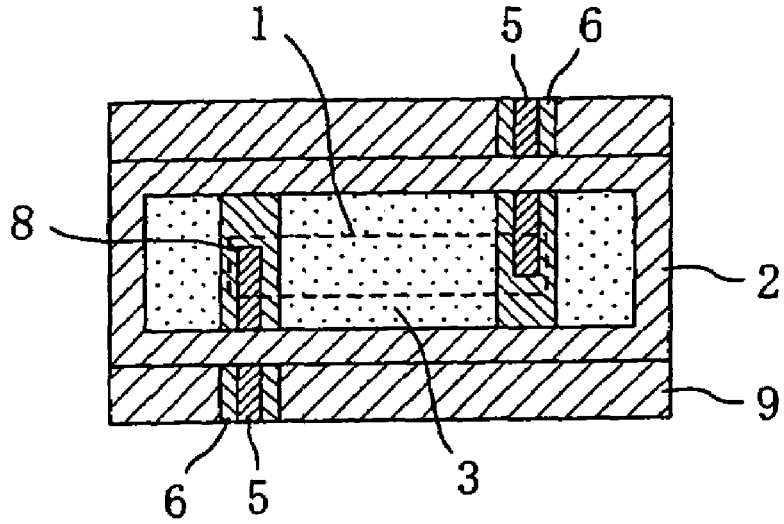
FIGS. 7(*a*) and 7(*b*) are vertical- and cross-sectional views of a high-frequency circuit device according to a fourth embodiment of the present invention, respectively.
Figure 7B:
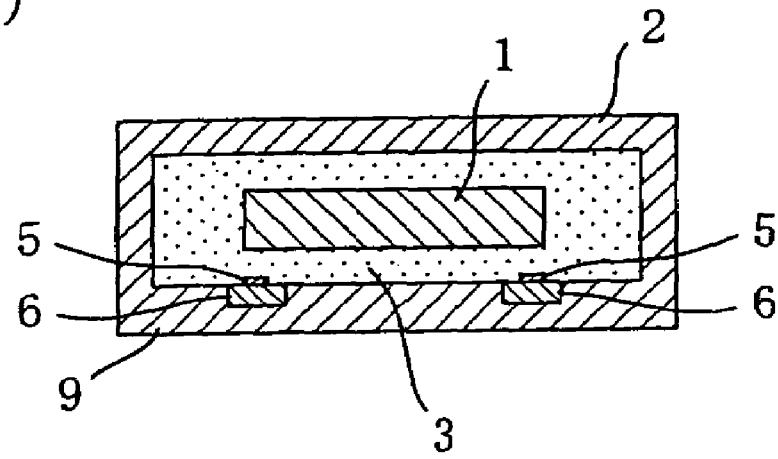

FIGS. 7(*a*) and 7(*b*) are vertical- and cross-sectional views of a high-frequency circuit device according to a fourth embodiment of the present invention, respectively. In FIG. 7(*a*), a position where a dielectric member 1 is disposed is indicated by a dashed line. In the high-frequency circuit device of this embodiment, a strip conductor 5 and a transmission-line substrate 6 which together form each of transmission lines 4 (microstrip-lines) are buried in a groove formed in a shielding conductor 2 so as to extend in parallel to a shorter side of an earth conductor layer 9, as shown in FIGS. 7(*a*) and (*b*). More specifically, the strip conductor 5 and the transmission-line substrate 6 are inserted into the groove of the earth conductor layer 9 so as to be located immediately under each of end portions of the dielectric member 1. An end portion of the strip conductor 5 faces the underside surface of the dielectric member 1. The structure for other parts of the high-frequency circuit device of this embodiment is basically the same as that of the first embodiment.

In this embodiment, the end portion of the strip conductor 5 located on the transmission-line substrate 6 as it is can be used as a coupling probe 8. Thus, besides the same effects as those of the first embodiment, the structure of a portion of the circuit being input/output coupled can be advantageously simplified.

Note that in the structure of the high-frequency circuit device of this embodiment, the degree of input/output coupling can be adjusted according to the height or lateral direction positional relationship between the transmission-line substrate 6 and the dielectric member 1. For example, there is a tendency that as the space between the transmission-line substrate 6 and the dielectric member 1 is reduced so that they get closer to each other, the degree of input/output coupling increases. As the transmission-line substrate 6 is closer to a center portion of the dielectric member 1, the input/output coupling degree tends to decrease. The high-frequency circuit device of this embodiment, as that of the first embodiment, can function as a resonator and be used as a low-loss, single-stage bandpass filter.

Note that in this embodiment, as an exemplary high-frequency circuit device, the high-frequency circuit device in which a dielectric member is disposed has been described. However, two dielectric members 1*a*, 1*b* may be disposed as in the third embodiment, or three or more dielectric members may be disposed. That is to say, the high-frequency circuit device can be utilized as a two-stage or multi-stage bandpass filter.

FIFTH EMBODIMENT

Figure 8:
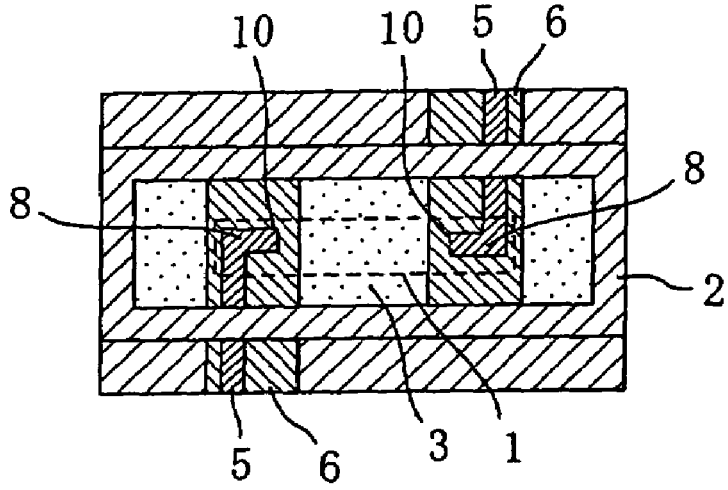
FIG. 8 is a vertical-sectional view of a high-frequency circuit device according to a fifth embodiment of the present invention.

FIG. 8 is a vertical-sectional view of a high-frequency circuit device according to a fifth embodiment of the present invention. In FIG. 8, a position where a dielectric member 1 is disposed is indicated by a dashed line. In the high-frequency circuit device of this embodiment, a strip conductor 5 and a transmission-line substrate 6 which together form each of transmission lines 4 (microstrip-lines) are buried in a groove formed in a shielding conductor 2 so as to extend in parallel to a shorter side of an earth conductor layer 9, as shown in FIG. 8. More specifically, the strip conductor 5 and the transmission-line substrate 6 are inserted into the groove of the earth conductor layer 9 so as to be located directly under each of end portions of the dielectric member 1. An end portion of the strip conductor 5 faces the underside surface of the dielectric member 1. Moreover, in this embodiment, an end portion 10 of the strip conductor 5 is bent through 90 degrees in a plane to form an L shape. The bent end portion 10 mainly functions as the input/output coupling probe 8. The structure of the high-frequency circuit device of this embodiment is basically the same as that of the first embodiment.

In this embodiment, the end portion of the strip conductor 5 located on the transmission-line substrate 6 as it is can be used as the coupling probe 8. Thus, the structure of input/output coupled parts of the circuit device can be advantageously simplified as in the fourth embodiment.

Particularly, in this embodiment, if the end portion functioning as a coupling probe is bent in the direction in which the degree of input/output coupling is increased, a highly effective resonator can be achieved. For example, if the bent end portion 10 is lengthened so as to be longer than a shorter side of the dielectric member 1, the input/output probe 8 can have a greater length than that of the fourth embodiment. Thus, with the high-frequency circuit device of this embodiment, elements in the electric field of a resonator mode can be effectively condensed to achieve a higher degree of in put/output coupling than that in the fourth embodiment. Moreover, the degree of the condensation can be advantageously adjusted with a fixed positional relationship between the transmission-line substrate 6 and the dielectric member 1 according to the length L of the end portion 10. The high-frequency circuit device of this embodiment, as that of the first embodiment, can function as a resonator and be used as a low-loss, single-stage bandpass filter.

SPECIFIC EXAMPLE OF FIFTH EMBODIMENT

A high-frequency circuit device having the structure shown in FIG. 8 has been formed in the following manner. As a dielectric member 1, a dielectric ceramic square pole (formed of a material containing $ZrO_2$—$TiO_2$—$MgNb_2O_6$ as a main component and having a relative dielectric constant of 42.2 and a fQ value of 43000 GHz) which has dimensions of 1×1×4 mm is prepared. Then, the dielectric member 1 is fixed in a shielding conductor 2 formed of a zinc-copper alloy and having inside walls plated with gold. The dimensions of inside of the shielding conductor 2 are 2×2×12 mm. In this case, polytetrafluoroethylene resin is used as a support member 3 to be filled in the space between the shielding conductor 2 and the dielectric member 1. As for transmission lines 4, a strip conductor 5 (having a characteristic impedance of 50Ω) of a gold film (having a thickness of 10 μm and a width of about 0.3 mm) is formed on a transmission-line substrate 6 made of sintered alumina so as to have an end portion 10 having a length of L mm.

It has been actually confirmed from results of measurements using a network analyzer that a resonance event occurs at around 26 GHz. This shows that the high-frequency circuit device can not only operate as a resonant circuit but also be utilized as a single-stage bandpass filter. The no-load Q value of the resonance was about 1000.

Figure 9:
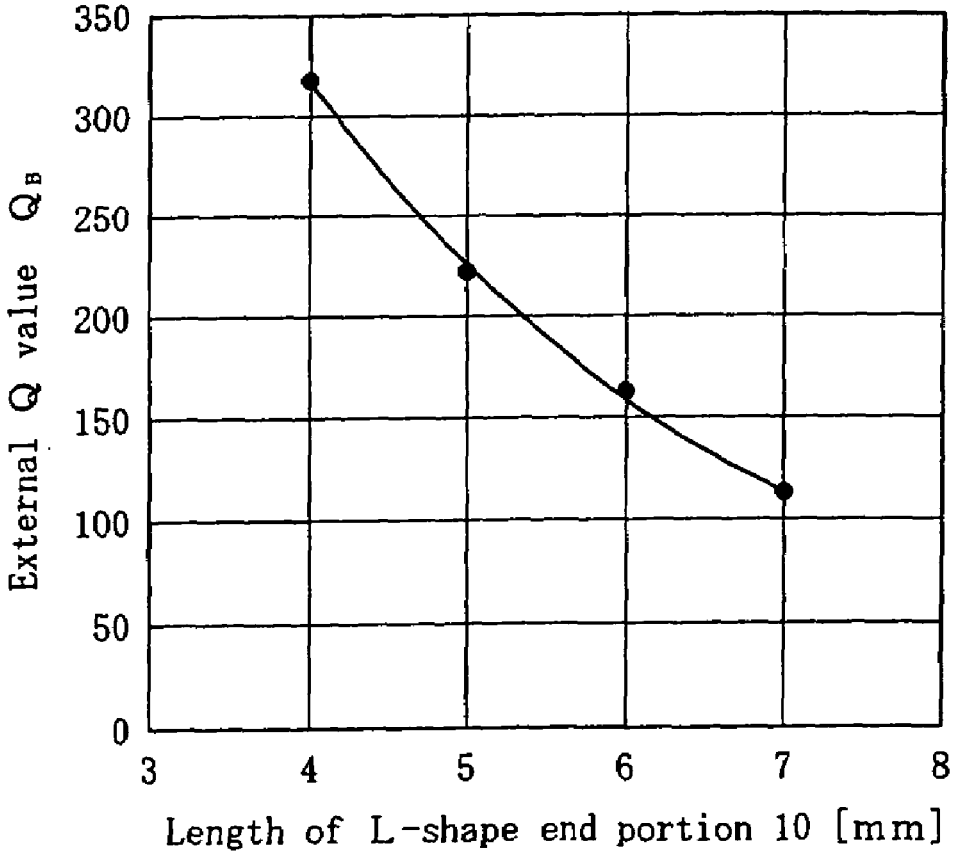
FIG. 9 is a graph showing simulation results obtained from a three-dimensional electromagnetic analysis of the relation between the length of the end portion of the high-frequency circuit device of a specific example of the fifth embodiment and the external Q value (Qe) representing the input/output coupling degree of the circuit.

FIG. 9 is a graph showing simulation results obtained from a three-dimensional electromagnetic analysis of the relation between the length of the end portion of the high-frequency circuit device of this specific example and the external Q value (Qe) representing the input/output coupling degree of the circuit. The stronger an input/output coupling is, the smaller the external Q value Qe becomes. Therefore, the external Q value Qe can be controlled in a wide range by adjusting the length L, as shown in FIG. 9.

SIXTH EMBODIMENT

Figure 10:
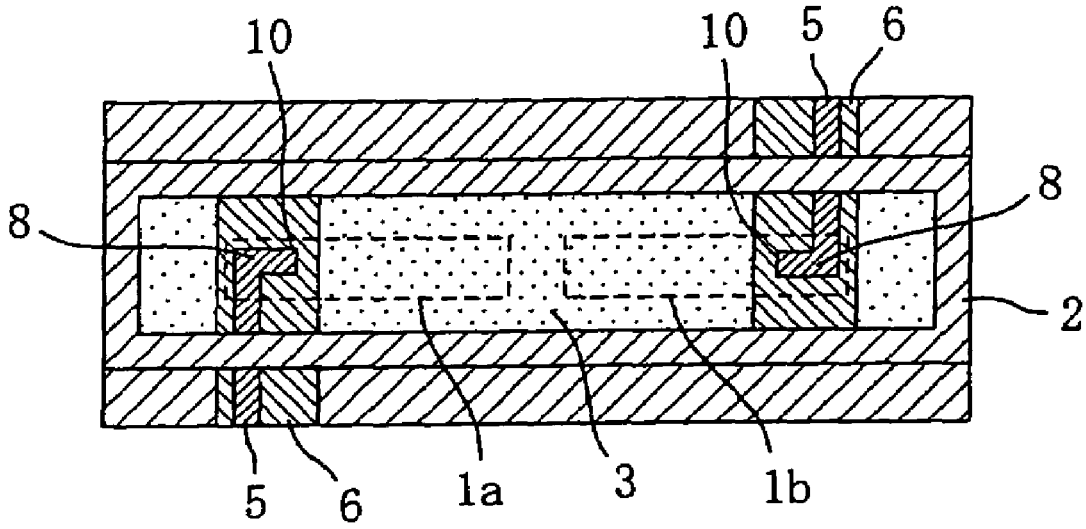
FIG. 10 is a cross-sectional view of a high-frequency circuit device according to a sixth embodiment of the present invention.

FIG. 10 is a cross-sectional view of a high-frequency circuit device according to a sixth embodiment of the present invention. The high-frequency circuit device of this embodiment has a structure in which two dielectric members 1*a*, 1*b* are disposed in series in the longitudinal direction so as to be located at almost the same height in a shielding conductor 2 as in the third embodiment. Also, a strip conductor 5 is bent through 90 degrees on the transmission-line substrate 6 to form an L shape as in the sixth embodiment. The basic structure for other parts of the high-frequency circuit device of this embodiment is basically the same as that in the fifth embodiment shown in FIG. 8.

The high-frequency circuit device of this embodiment can function as a low-loss, two-stage bandpass filter, as has been confirmed in a specific example which will be descried hereinafter.

With the circuit of this embodiment, if the coupling structure of the fifth embodiment can be utilized as a multi-stage bandpass filter, greater effects can be attained. The reason for this is as follows. In a bandpass filter, normally, it is preferable that the input/output coupling degree is relatively high and the coupling degree is accurately controlled to achieve desired properties.

Note that in this embodiment, an exemplary high-frequency circuit device functioning as a two-stage bandpass filter has been described. However, it is also very effective that three or more dielectric members are used and thus the high-frequency circuit device is utilized as a three-stage or multi-stage bandpass filter.

SPECIFIC EXAMPLE OF SIXTH EMBODIMENT

A high-frequency circuit device having the structure shown in FIG. 10 has been formed in the following manner. As dielectric members 1*a*, 1*b*, two dielectric ceramic square poles (formed of a material containing $ZrO_2$—$TiO_2$—$MgNb_2O_6$ as a main component and having a relative dielectric constant of 42.2 and a fQ value of 43000 GHz) each of which has dimensions of 1×1×4 mm are prepared. Then, the dielectric members 1*a*, 1*b* are fixed in a shielding conductor 2 formed of a zinc-copper alloy and having inside walls plated with gold. The dimensions of inside of the shielding conductor 2 are 2×2×12 mm. In this case, polytetrafluoroethylene resin is used as a support member 3 to be filled in the space between the shielding conductor 2 and each of the dielectric members 1*a*, 1*b*. As for transmission lines 4, a strip conductor 5 (having a characteristic impedance of 50Ω) of a gold film (having a thickness of 10 μm and a width of about 0.3 mm) is formed on a transmission-line substrate 6 made of sintered alumina so as to have an end portion 10 having a length of L mm.

Figure 11:
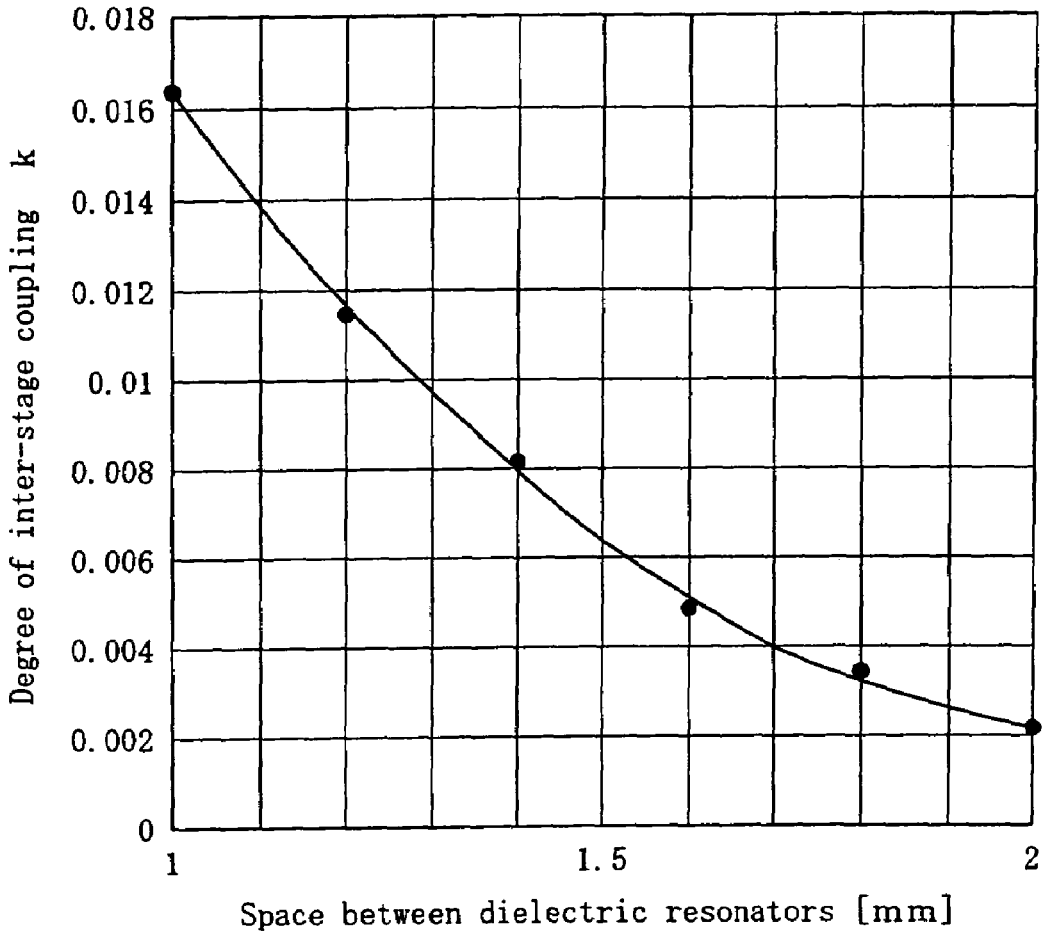
FIG. 11 is a graph showing simulation results for the relation between the coupling degree k and the space d between two dielectric members of a specific example of the sixth embodiment.

FIG. 11 is a graph showing simulation results for the relation between the coupling degree k and the space d between the dielectric members 1*a*, 1*b* of this specific example. Seen from FIG. 11, the coupling degree between the dielectric members (i.e., the inter-stage coupling degree) can be set according to the space therebetween. Actually, a Chebyshev filter prototype having a center frequency of about 26 GHz, a fractional band width of 0.3% and an in-band ripple of 0.005 dB was designed and made using the structure of the high-frequency circuit device of this specific example. Based on this filter specification, necessary input/ output coupling degree and inter-stage coupling degree were calculated. The obtained input/output coupling degree and inter-stage coupling degree were Qe (external Q value)=120 and k=0.0083, respectively. As can be seen from FIGS. 9 and 11, it has been confirmed based on the calculation results that appropriate values for the length of the end portion L and the space d are 0.7 mm and 1.2 mm, respectively. Thus, a prototype high-frequency circuit device which could achieve these values was actually made.

Figure 12:
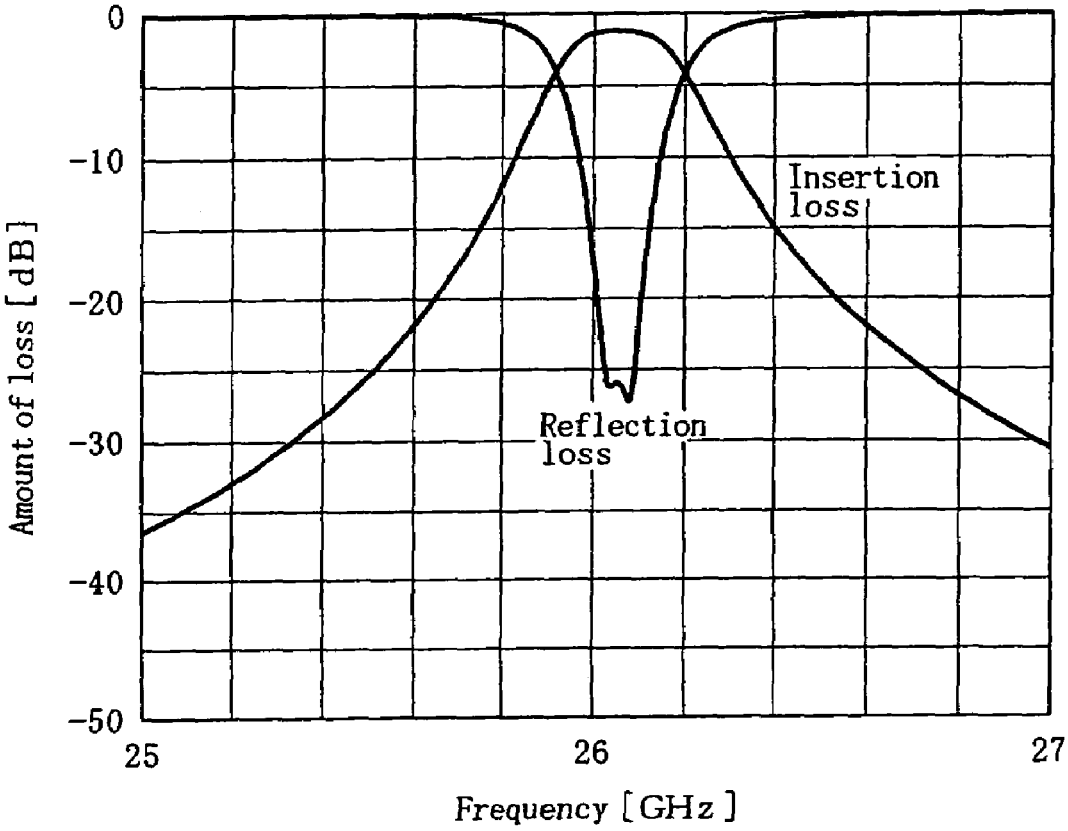
FIG. 12 is a graph showing frequency characteristics with respect to loss amount for the prototype high-frequency circuit device which has been made in the specific example of the sixth embodiment.

FIG. 12 is a graph showing frequency characteristics with respect to loss amount for the prototype high-frequency circuit device which has been made in the above-described manner. FIG. 12 shows that the high-frequency circuit device finely operated as a two-stage bandpass filter. The insertion loss thereof was about 1.2 dB. If a filter having similar characteristics is made using a known microstrip-line resonator, insertion loss is estimated to be several times more than that of the high-frequency circuit device of this specific example, i.e., it is estimated to be several dB. Thus, the sufficient validity of the high-frequency circuit device has been confirmed.

SEVENTH EMBODIMENT

Figure 13:
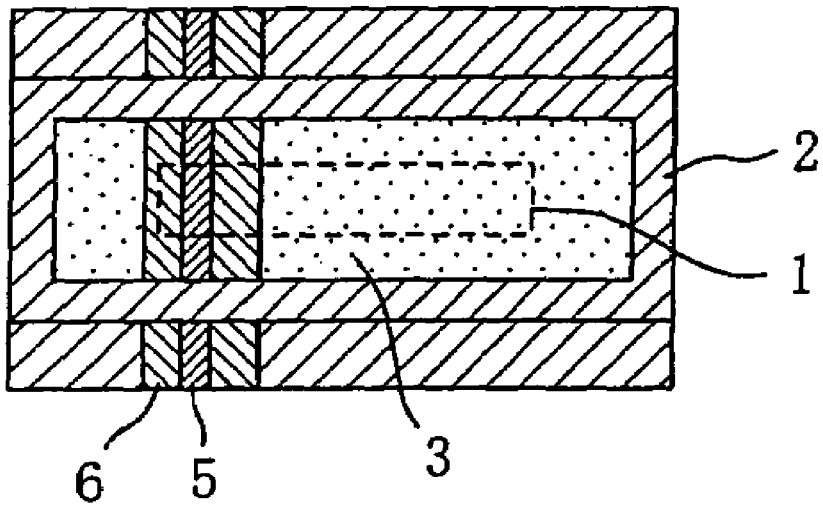
FIG. 13 is a cross-sectional view of a high-frequency circuit device according to a seventh embodiment of the present invention.

FIG. 13 is a cross-sectional view of a high-frequency circuit device according to a seventh embodiment of the present invention. In the first to sixth embodiments, the high-frequency circuit device includes two transmission lines (microstrip-lines). In contrast, the high-frequency circuit device of this embodiment has a structure in which a dielectric member 1 is coupled with a single transmission line 4 which is formed of a passing-through-type microstrip-line and whose end portions are to be input/output terminals (input/output coupling probe), as shown in FIG. 13. In this case, the dielectric member 1 indicated by a dashed line is disposed so as to be located close to the transmission line 4. Thus, an input/output coupling occurs due to an overlap of the electromagnetic field of the transmission line 4 and the electromagnetic field of resonator mode of the dielectric line 4. As a result, the energy of the high-frequency signal transmitted via the transmission line 4 is partially absorbed by the dielectric member 1. Therefore, in the high-frequency device structure, the end portions of the transmission line 4 serve as input/output terminals, and it can be seen from permeation characteristics between the end portions shown in FIG. 12 that the high-frequency circuit device operates as a so-called band stop filter (notch filter) in which the transmittance is reduced around the resonance frequency of the dielectric member 1.

Note that in this embodiment, the case where a dielectric member 1 is provided has been described. However, with a plurality of dielectric members 1 provided, when the high-frequency circuit device is applied to a multi-stage band stop filter, this embodiment is also effective.

EIGHTH EMBODIMENT

Figure 14:
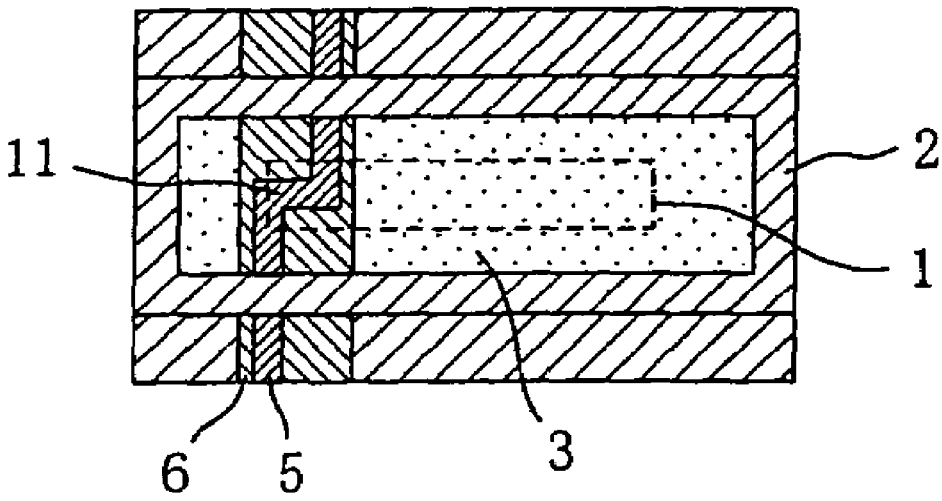
FIG. 14 is a cross-sectional view of a high-frequency circuit device according to an eighth embodiment of the present invention.

FIG. 14 is a cross-sectional view of a high-frequency circuit device according to an eighth embodiment of the present invention. As shown in FIG. 14, the high-frequency circuit device of this embodiment has a structure in which a dielectric member 1 is coupled with a single transmission line 4 which is formed of a passing-through-type microstrip-line and whose end portions are to be input/output terminals (input/output coupling probe) as in the seventh embodiment. However, this embodiment differs from the seventh embodiment in which the strip conductor 5 extends linearly in that a strip conductor 5 includes a bent portion 11 under a dielectric member 1. In this embodiment, the dielectric member 1 indicated by a dashed line is also disposed so as to be located close to the transmission line 4. Thus, an input/output coupling occurs due to an overlap of the electromagnetic field of the transmission line 4 and the electromagnetic field of the resonator mode of the dielectric member 1. Accordingly, the energy of the high-frequency signal transmitted via the transmission line 4 is partially absorbed by the dielectric member 1. Therefore, in the high-frequency device structure, the end portions of the transmission line 4 serve as input/output terminals, and it can be seen from permeation characteristics between the end portions shown in FIG. 12 that the high-frequency circuit device operates as a so-called band stop filter (notch filter) in which the transmittance is reduced around the resonance frequency of the dielectric member 1.

In addition, in the high-frequency circuit device of this embodiment, the bent portion 11 of the strip conductor 5 extends in the longitudinal direction of the dielectric member 1. Thus, the direction of the electromagnetic field of the resonator mode matches that of the transmission line 4 at the bent portion 11. Accordingly, a very large coupling can be achieved between the electromagnetic wave transmitting through the transmission line 4 and the electromagnetic field of the resonator mode, thus resulting in strong blocking properties.

Note that in this embodiment, the case where a dielectric member 1 is provided has been described. However, with a plurality of dielectric members 1 provided, when the high-frequency circuit device is applied to a multi-stage band stop filter, this embodiment is also effective.

SPECIFIC EXAMPLE OF EIGHTH EMBODIMENT

A high-frequency circuit device having the structure shown in FIG. 14 has been formed in the following manner. As a dielectric member 1, a dielectric ceramic square pole (formed of a material containing $ZrO_2$—$TiO_2$—$MgNb_2O_6$ as a main component and having a relative dielectric constant of 42.2 and a fQ value of 43000 GHz) which has dimensions of 1×1×4 mm is prepared. Then, the dielectric member 1 is fixed in a shielding conductor 2 formed of a zinc-copper alloy and having inside walls plated with gold. The dimensions of inside of the shielding conductor 2 are 2×2×12 mm. In this case, polytetrafluoroethylene resin is used as a support member 3 to be filled in the space between the shielding conductor 2 and the dielectric member 1. As for transmission lines 4, a strip conductor 5 (having a characteristic impedance of 50Ω) of a gold film (having a thickness of 10 μm and a width of about 0.3 mm) is formed on a transmission-line substrate 6 made of sintered alumina so as to have an end portion 10 having a length of L mm.

Figure 15:
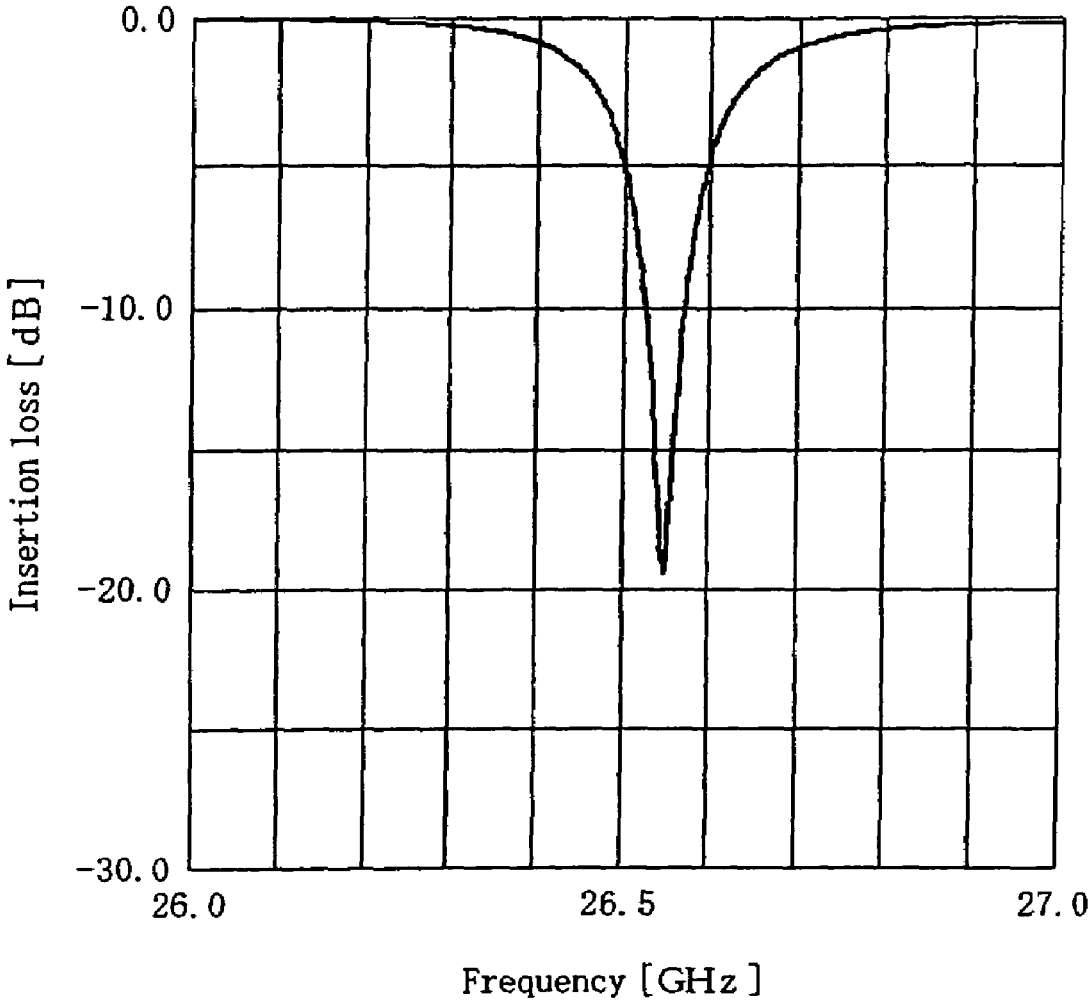
FIG. 15 is a graph showing simulation results obtained from an electromagnetic analysis of frequency characteristics with respect to insertion loss for the high-frequency circuit device of the eighth embodiment.

FIG. 15 is a graph showing simulation results obtained from an electromagnetic analysis of frequency characteristics with respect to insertion loss for the high-frequency circuit device of this specific example. As can be seen from FIG. 15, the high-frequency circuit device of this specific example operates as a band stop filter in which the amount of attenuation of a signal is large around the resonance frequency of a resonator.

NINTH EMBODIMENT

Figure 16A:
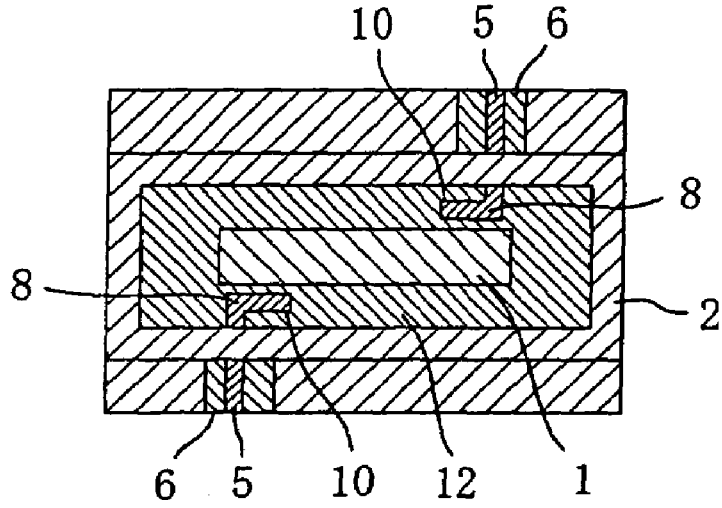
FIGS. 16(*a*), 16(*b*) and 16(*c*) are a cross-sectional view, a vertical-sectional view in the longitudinal direction, and a vertical-sectional view perpendicular to the longitudinal direction, illustrating a high-frequency circuit device according to an ninth embodiment of the present invention, respectively.
Figure 16B:
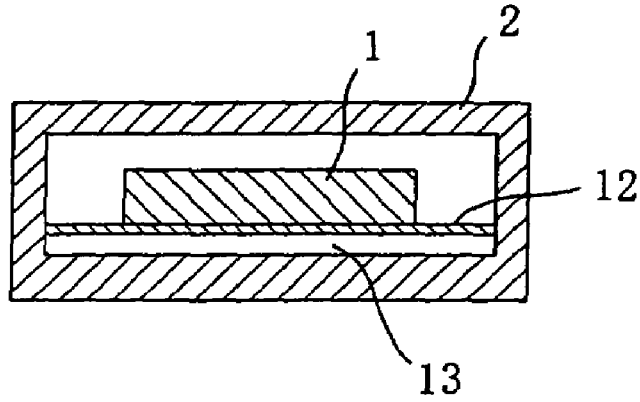
Figure 16C:
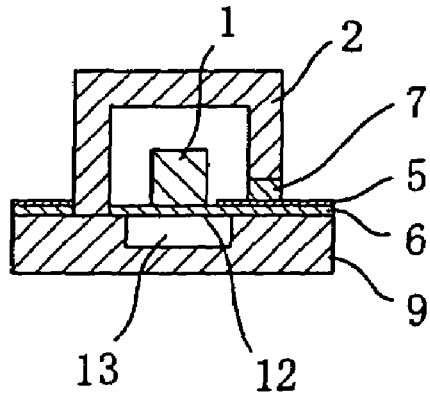

FIGS. 16(*a*), 16(*b*) and 16(*c*) are a cross-sectional view, a vertical-sectional view in the longitudinal direction, and a vertical-sectional view perpendicular to the longitudinal direction, illustrating a high-frequency circuit device according to an ninth embodiment of the present invention, respectively. As shown in FIGS. 16(*a*) through 16(*c*), the high-frequency circuit device of this embodiment includes a dielectric member 1 which is formed of a ceramic material such as a material containing, e.g., $ZrO_2$—$TiO_2$—$MgNb_2O_6$ as a main component and has a square pole shape, a shielding conductor 2 which is formed of a zinc-copper alloy, surrounds the dielectric member 1 and has gold-plated inside walls, a dielectric substrate 12 which is formed of, e.g., alumina and supports the dielectric member 1, and a pair of transmission lines 4 formed of a microstrip-line.

In this embodiment, a groove 13 which extends in the longitudinal direction of an earth conductive layer 9 is formed. The inside of the groove 13 is empty. Moreover, the inside of a shielding conductor 2 is also empty. The dielectric member 1 is placed on the dielectric substrate 12 over the groove 13. That is to say, the dielectric substrate 12 functions as a support member for supporting the dielectric member 1 in this embodiment.

Moreover, each of transmission lines 4 includes a transmission-line substrate 6, a strip conductor 5 formed of a silver ribbon or the like, and the earth conductor layer 9 which is a part of the shielding conductor 2. Each said transmission line 4 is inserted to a region of the high-frequency circuit device surrounded by the shielding conductor through the part of the shielding conductor 2. More specifically, a window is formed in part of a side wall of the shielding conductor 2 perpendicular to the longitudinal direction of the shielding conductor 2, the transmission line 4 is inserted into the window and the upper surface of the transmission line 4 is covered with an insulator 7 at a window portion. The insulator 7 is provided to prevent a short-circuit of the strip conductor 5 located on the transmission-line substrate 6 to the shielding conductor 2. In the inside of the shielding conductor 2, the strip conductor 5 extends on the dielectric substrate 12 and an end portion 10 thereof is bent through almost 90 degree to form an L shape. The end portion 10 of the strip conductor 5 faces a side surface of the dielectric member 1 extending in its longitudinal direction. The end portion 10 functions as a coupling probe.

In this embodiment, the earth conductor layer 9, which is a part of the shielding conductor 2, serves as a ground plane. Therefore, to connect each of the transmission lines 4 and an external circuit to each other, only application of a signal voltage between the strip conductor 9 and the earth conductor layer 9 is required. Thus, it is possible to suppress signal loss to a low level.

In the structure of the high-frequency circuit device of this embodiment, it is possible to make the dielectric member 1 resonate in a resonator mode called "$TM_{11\delta}$ mode" for a resonator with a rectangular cross section by appropriately selecting shapes (and materials) for the dielectric member 1, the shielding conductor 2, the dielectric substrate 12, and the groove 13. Thus, with the high-frequency circuit device of this embodiment, a $TM_{11\delta}$ mode resonator can be achieved. Also, the high-frequency circuit device of this embodiment can be used as a single-stage bond pass filter.

Specifically, with the high-frequency circuit device of this embodiment, this embodiment is characterized in that the transmission-line substrate 6 and the dielectric substrate 12 can be unified and the support member 3 of the first through eighth embodiments is not necessarily provided because the dielectric member 1 is fixed by the dielectric substrate 12, as can be seen from FIG. 16.

Note that each of the transmission lines 4 may be inserted from the front or back of the dielectric member 1 in this embodiment.

Furthermore, the groove 13 is not necessarily provided. Even though the groove 13 is not provided and the underside surface of the dielectric substrate 12 is in direct contact with an inside wall of the shielding conductor 2, a resonator which can operate in the same manner as that of this embodiment can be obtained. However, if the shielding conductor 2 is in contact with part of the underside surface of the dielectric substrate 12 located directly under the dielectric member 1, a large high-frequency current may flow, causing an increase in the loss. In contrast, if the groove 13 is provided as shown in FIG. 16, the loss can be reduced.

Moreover, in the high-frequency circuit device of this embodiment shown in FIGS. 16(*a*) through 16(*c*), the shape of the coupling probe 8 does not have to be an L shape obtained by bending the end portion 10 of the strip conductor 5. As shown in FIGS. 1(*a*) and 2(*b*), the linearly extending end portion of the strip conductor 5 can function as the coupling probe 8. As another option, the respective end portions 10 of two strip conductors 5 may be bent in the same direction, or in the direction in which they go apart from each other.

Moreover, it is also effective to form the coupling probe 8 on the underside surface of the dielectric substrate 12. In this case, if the coupling probe 8 is formed directly under the dielectric member 1, a large coupling amount can be achieved. However, in this case, in order to electrically connecting the dielectric member 1 and the strip conductor 5 to each other, it is necessary to make the strip conductor 5 on the surface of the dielectric substrate 12 and the coupling probe 8 on the underside surface of the dielectric substrate 12 capacitively coupled with a capacitance interposed therebetween, or to form the strip conductor 5 on the underside surface of the transmission-line substrate 6.

Moreover, in the structure of this embodiment, as in the seventh or eighth embodiment (see FIG. 13 or FIG. 14), the dielectric member 1 may be coupled with the passing-through-type transmission lines 4 each having end portions that are to be input/output terminals. In this case, it is possible to operate the high-frequency circuit device as a so-called band stop filter using both of the edges of each said transmission line 4 as the input/output terminals.

Moreover, in this embodiment, it is more preferable to use as the dielectric substrate 12 a material having a lower dielectric constant than that of the dielectric member 1. For example, assume that a material having a relative dielectric constant of 20 or more is used as the dielectric member 1. When characteristics and the structure of the high-frequency circuit device of this embodiment are taken into consideration, the use of an alumina substrate or some other dielectric substrate having a relatively low dielectric constant is effective.

TENTH EMBODIMENT

Figure 17A:
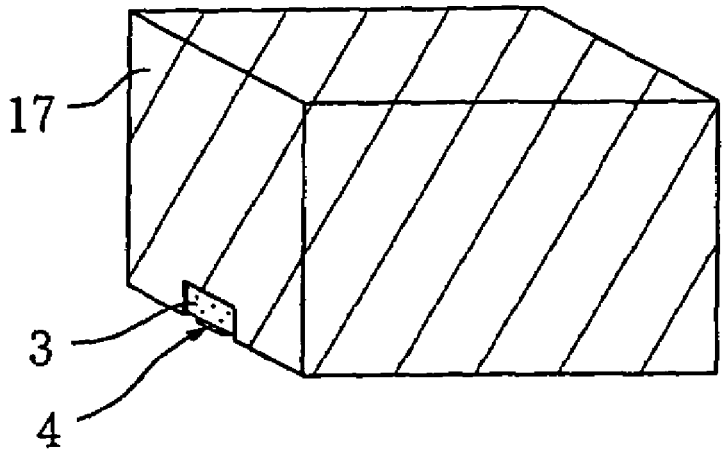
FIGS. 17(*a*) and 17(*b*) are oblique perspective views from the top and bottom illustrating a high-frequency circuit device according to a tenth embodiment of the present invention, respectively.
Figure 17B:
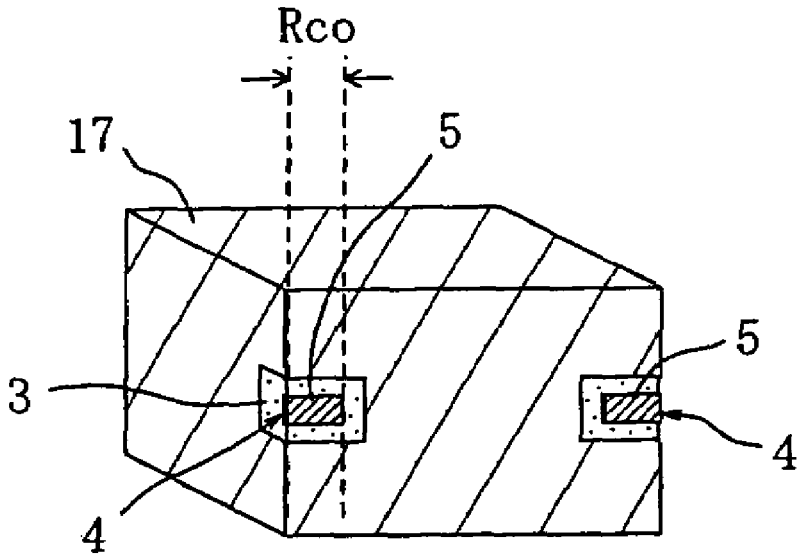
Figure 18A:
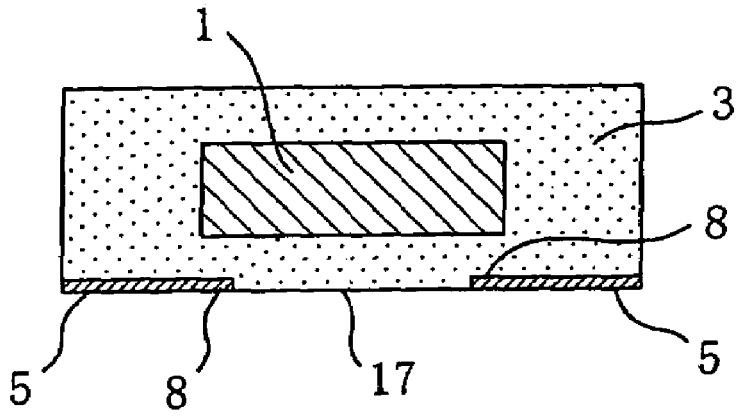
FIGS. 18(*a*) and 18(*b*) are vertical- and cross-sectional views of the high-frequency circuit device of the tenth embodiment, respectively.
Figure 18B:
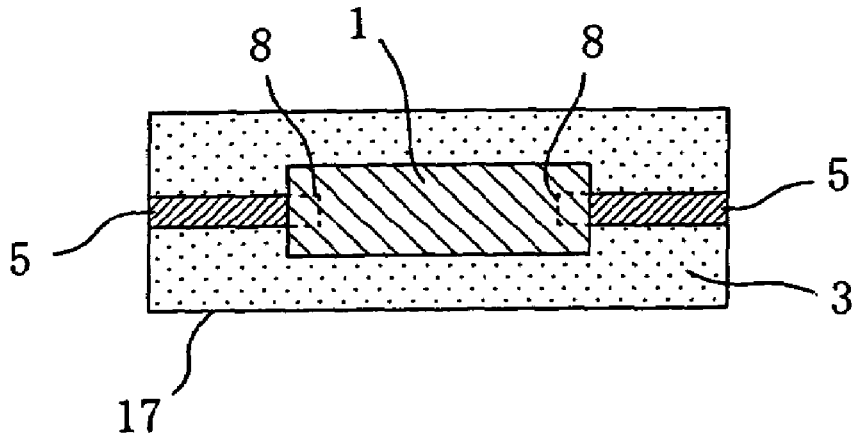

FIGS. 17(*a*) and 17(*b*) are oblique perspective views from the top and bottom illustrating a high-frequency circuit device according to a tenth embodiment of the present invention, respectively. FIGS. 18(*a*) and 18(*b*) are vertical- and cross-sectional views of the high-frequency circuit device of this embodiment, respectively.

As shown in FIGS. 17(*a*) and 17(*b*) and FIGS. 18(*a*) and 18(*b*), in the high-frequency circuit device of this embodiment, a square-pole-shape dielectric member 1 of a ceramic material or the like is provided and the dielectric material 1 is fixed and supported by a support member 3 of polytetrafluoroethylene resin. Then, a conductive coating film 17 is formed on the outer surface of the support member 3 by copper plating or the like. Moreover, part of the conductive coating film 17 is separated to form a strip conductor 5 and part of the rest of the conductive coating film 17 is formed into transmission lines 4. In the conductive coating film 17, the underside surface of the dielectric member 1 and the strip conductor 5 face each other so that an input/output coupling of the strip conductor 5 to the high dielectric member 1 occurs.

In this embodiment, the strip conductor 5 and the conductive coating film 17 together form a coplanar stripline in a region Rco. Therefore, when the high-frequency circuit device is intended to be connected with an external circuit, a signal voltage may be applied between the srtip conductor 5 and the conductive coating film 17.

In the structure of the high-frequency circuit device of this embodiment, it is possible to make the dielectric member 1 resonate in a resonator mode called "$TM_{11\delta}$ mode" for a resonator with a rectangular cross section by appropriately selecting shapes and materials for the dielectric member 1, the conductive coating film 17 and the support member 3. Thus, with the high-frequency circuit device of this embodiment, a $TM_{11\delta}$ mode resonator can be achieved. Also, the high-frequency circuit device of this embodiment can be used as a single-stage bandpass filter.

In addition, in the high-frequency circuit device of this embodiment, the strip conductor 5 that forms the transmission lines 4, and the conductive coating film 17 that is a ground plane can be formed on a single plane. Thus, surface mounting can be performed in a simple manner.

Note that in the high-frequency circuit device of this embodiment, the transmission lines 4 can be formed laterally with respect to the dielectric member, as in the second embodiment (see FIG. 2). That is to say, the strip conductor 5 can be formed on the upper or underside surface of the square pole of FIG. 17(*a*).

ELEVENTH EMBODIMENT

Figure 19A:
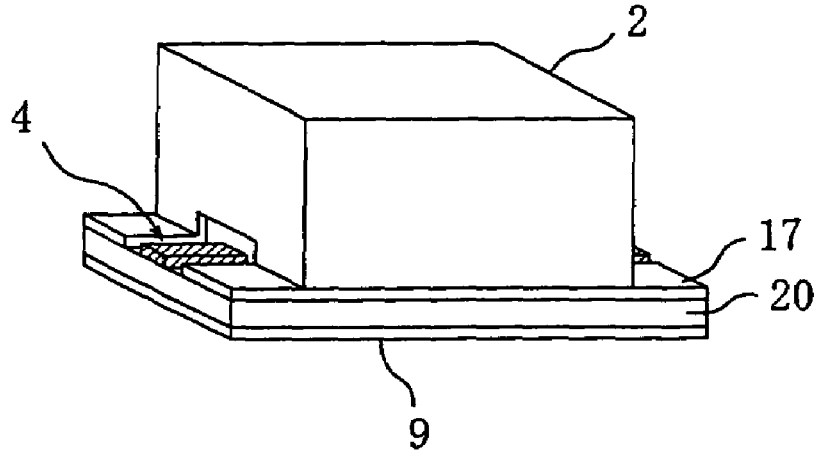
FIGS. 19(*a*), 19(*b*) and 19(*c*) are perspective, vertical-sectional and cross-sectional views of a high-frequency circuit device according to an eleventh embodiment of the present invention, respectively.
Figure 19B:
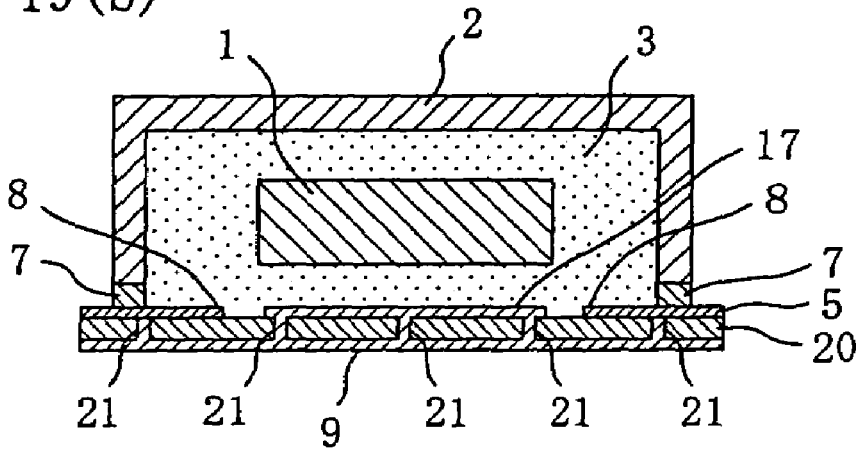
Figure 19C:
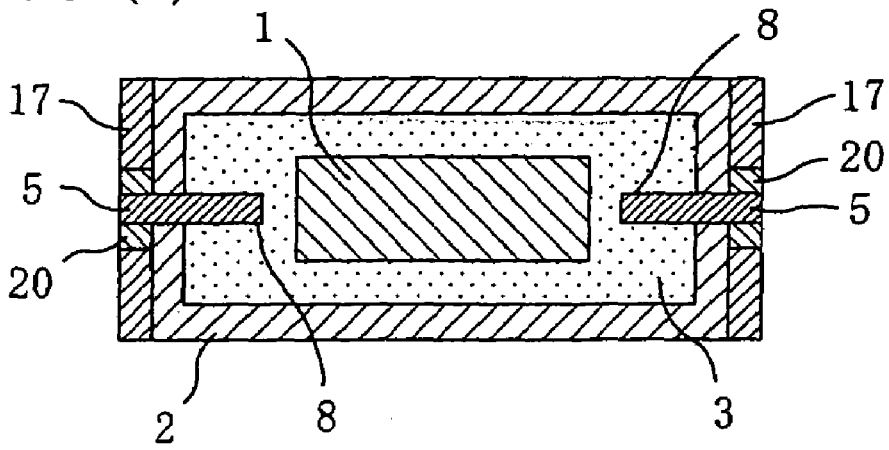
Figure 20A:
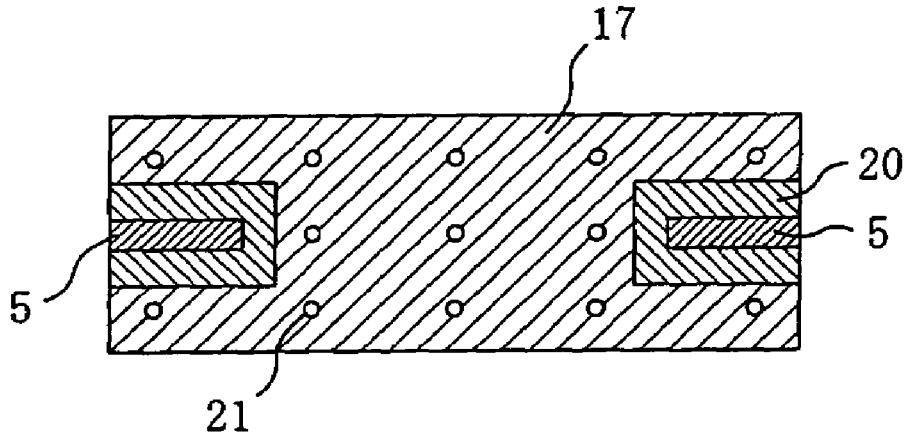
FIGS. 20(*a*) and 20(*b*) are top and bottom views of a dielectric substrate of the eleventh embodiment, respectively.
Figure 20B:
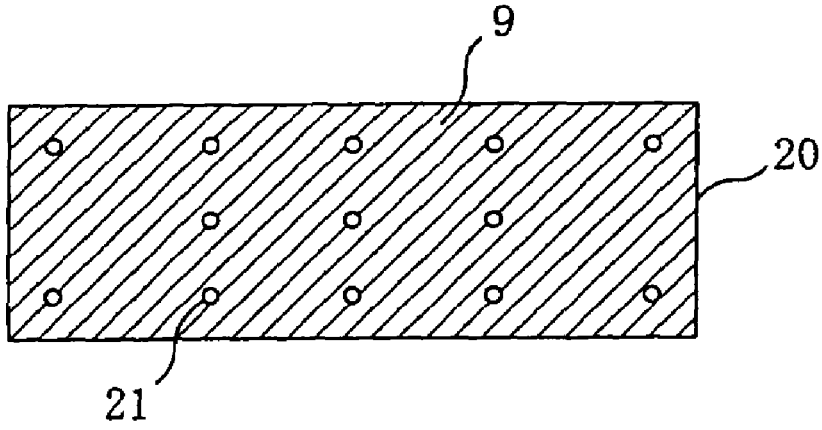

FIGS. 19(*a*), 19(*b*) and 19(*c*) are perspective view, vertical-sectional view and cross-sectional view of a high-frequency circuit device according to an eleventh embodiment of the present invention, respectively. FIGS. 20(*a*) and 20(*b*) are top and bottom views of a dielectric substrate of the eleventh embodiment, respectively. As shown in FIGS. 19(*a*) through 19(*c*) and FIGS. 20(*a*) through 20(*c*), a square-pole-shape dielectric member 1 formed of a ceramic material or the like is disposed in a shielding conductor 2 and is fixed by a support member 3. The space between the dielectric member 1 and the shielding conductor 2 is filled with the support member 3. Moreover, a conductive coating film 17 which is formed of a metal film and forms part of the shielding conductor 2 is provided on the upper surface of a dielectric substrate 20 formed of a ceramic material or the like. An earth conductor layer 9, i.e., a ground plane is formed on the underside surface of the dielectric substrate 20.

Moreover, each of the transmission lines 4 includes the dielectric substrate 20, a strip conductor 5 formed of a portion separated from the conductive coating film 17, and the earth conductor layer 9 supporting the dielectric substrate from the underside surface thereof. The conductive coating film 17 and the earth conductor layer 9 are electrically connected to each other through a via hole 21 passing through the dielectric substrate 20. Then, each of the transmission lines 4 is inserted into a region of the high-frequency circuit device surrounded by the shielding conductor through part of the shielding conductor 2. More specifically, a window is formed in part of a side wall of the shielding conductor 2 perpendicular to the longitudinal direction of the shielding conductor 2, each of the transmission lines 4 is inserted into the window, and the upper surface of each of the transmission lines 4 is covered with an insulator 7 at a window portion. The insulator 7 is provided to prevent the short-circuit of the strip conductor 5 to the shielding conductor 2. In the shielding conductor 2, a pointed-end potion of the strip conductor 5 faces the underside surface of the dielectric substrate 20 (and also faces a side surface of the dielectric member 1 extending perpendicularly to the longitudinal direction) to function as a coupling probe portion 8.

In this embodiment, the earth conductor layer 9, i.e., a part of the shielding conductor 2 serves as the ground plane of the transmission lines 4. Therefore, to connect the transmission line 4 and an external circuit, only application of a signal voltage between the strip conductor 5 and the earth conductor layer 9 is required. Thus, it is possible to suppress signal loss to a lower level.

In the structure of the high-frequency circuit device of this embodiment, it is possible to make the dielectric member 1 resonate in a resonator mode called "$TM_{11\delta}$ mode" for a resonator with a rectangular cross section by appropriately selecting shapes and materials for the dielectric member 1, the shielding conductor 2, the dielectric substrate 20, and the support member 3. Thus, with the high-frequency circuit device of this embodiment, a $TM_{11\delta}$ mode resonator can be achieved. Also, the high-frequency circuit device of this embodiment can be used as a low-loss, single-stage bandpass filter.

Moreover, in the high-frequency circuit device of this embodiment, the strip conductor 5 and the conductive coating film 17 can be formed of a common metal film. Thus, the number of parts to be assembled can be reduced and therefore variations in properties resulting from variations among assembled parts can be advantageously suppressed.

Note that in this structure, the transmission lines 4 can be formed laterally with respect to the dielectric member 1 as shown in FIG. 2 of the first embodiment.

TWELFTH EMBODIMENT

Figure 21A:
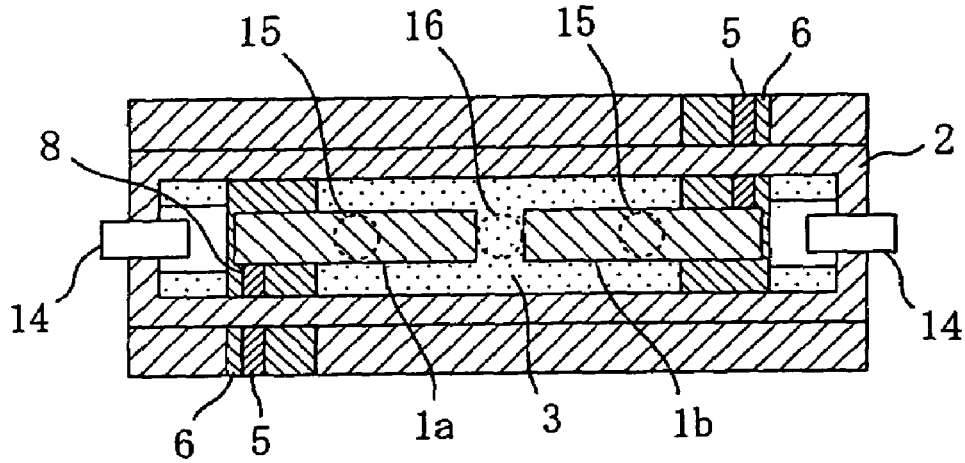
FIGS. 21(*a*) and 21(*b*) are vertical- and cross-sectional views of a high-frequency circuit device according to a twelfth embodiment of the present invention, respectively.
Figure 21B:
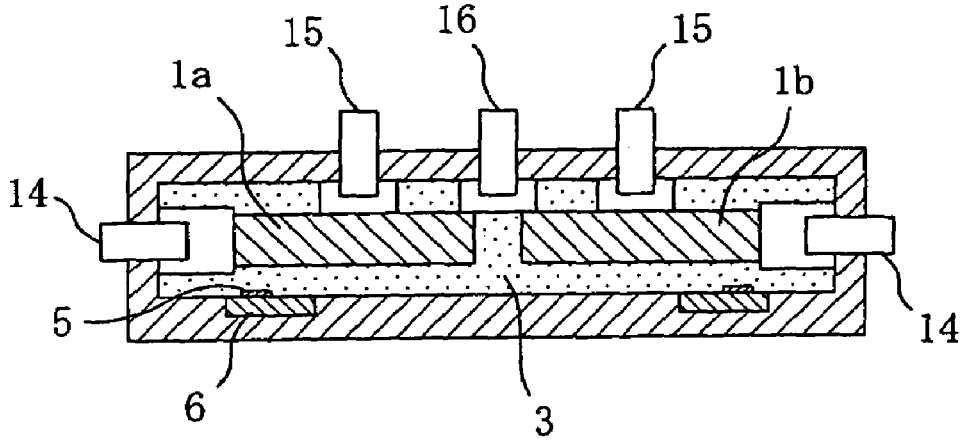

FIGS. 21(*a*) and 21(*b*) are vertical- and cross-sectional views of a high-frequency circuit device according to a twelfth embodiment of the present invention, respectively. As shown in FIGS. 21(*a*) and 21(*b*), the high-frequency circuit device of this embodiment includes a shielding conductor 2 in which two dielectric members 1*a*, 1*b* are disposed in series in the longitudinal direction so as to be located at almost the same height. The high-frequency circuit device further includes: two frequency adjustment screws 14 disposed so that each of them passes through a side wall of the shielding conductor 2 perpendicular to the longitudinal direction of the shielding conductor 2 and faces the edge face of an associated one of the dielectric members 1*a*, 1*b*; two frequency adjustment screws 15 disposed so that each of them passes through the upper wall of the shielding conductor 2 and faces a center portion of the upper surface of an associated one of the dielectric members 1*a*, 1*b*; and an inter-stage coupling degree adjustment screw 16 disposed so as to pass through the upper wall of the shielding conductor 2 and to face the space between the dielectric members 1$a$, 1$b$. Moreover, a support member 3 is removed, as necessary, from around the screws 14, 15, and 16 so that each of the screws 14, 15, and 16 can be inserted into the shielding conductor 2. The basic structure for other parts of the circuit is basically the same as that of high-frequency circuit device of the fourth embodiment shown in FIGS. 7($a$) and 7($b$).

With the structure of high-frequency circuit device of this embodiment, the electromagnetic distribution around the dielectric members 1$a$, 1$b$ is adjustable. More specifically, the resonance frequency of a resonator and the degree of a coupling between resonators can be adjusted by changing the insertion amounts of the frequency adjustment screws 14 and 15, and the insertion amount of the inter-stage coupling adjustment screw 16, respectively. Thus, deterioration of properties of a high-frequency circuit device due to mismeasurements in processing and assembling steps can be recovered by adjustments performed after the high-frequency circuit device has been fabricated. Therefore, efficiency in fabrication process steps can be greatly improved.

Note that in this embodiment, the structure of the two-stage bandpass filter has been described as an example. However, this embodiment is not limited thereto, but is applicable to a single-stage filter, or a three- or more-stage filter.

Frequency and inter-stage adjustments do not have to be performed using the screws but may be done using other members such as a pole-shape or plate-shape member having the same function as that of the screws.

Moreover, in the first through eleventh embodiments, adjustments for the resonance frequency and inter-stage coupling degree of the circuit can be performed using members such as a screw. In such a case, the same effects as those of this embodiment can be attained.

Note that if frequency adjustment screws are disposed so as to have the same positional relationship and the same axial direction as those of the frequency adjustment screws 14, i.e., each of the screws is disposed to face an end portion of an associated one of the dielectric members 1$a$, 1$b$, frequency can be effectively adjusted as has been described in this embodiment. On the other hand, if three or more stages of dielectric members are provided, the frequency adjustment using such screws is applicable only to frequency adjustment for dielectric members located at both ends. Then, it is effective that a frequency adjustment screw is provided perpendicularly to each of dielectric members in the same manner where the frequency adjustment screws 15 are disposed. More precisely, it is effective to dispose a frequency screw perpendicularly to the direction in which the electric field of a TM mode extends. Moreover, as for the insertion position of each of the frequency adjustment screws, it is the most effective that a frequency adjustment screw is inserted so as to face a portion of each said dielectric members 1$a$, 1$b$ which has the strongest electric field, i.e., a center potion of each of the dielectric members 1$a$, 1$b$ in this embodiment. In this case, frequency adjustment using the frequency adjustment screws is also advantageously applicable to a high-frequency circuit device in which three- or more-stage dielectric members are disposed.

SPECIFIC EXAMPLE OF TWELFTH EMBODIMENT

A high-frequency circuit device having the structure shown in FIGS. 21($a$), 21($b$) has been formed in the following manner. As dielectric members 1$a$, 1$b$, two dielectric ceramic square poles (formed of a material containing $ZrO_2$—$TiO_2$—$MgNb_2O_6$ as a main component, having a relative dielectric constant of 42.2 and a fQ value of 43000 GHz) each of which has dimensions of 1×1×4 mm are prepared. Then, the dielectric members 1$a$, 1$b$ are fixed in a shielding conductor 2 formed of a zinc-copper alloy and having inside walls plated with gold. The dimensions of inside of the shielding conductor 2 are 2×2×12 mm. In this case, polytetrafluoroethylene resin is used as a support member 3 to be filled in the space between the shielding conductor 2 and each of the dielectric members 1$a$, 1$b$. As for transmission lines 4, a strip conductor 5 (having a characteristic impedance of 50Ω) of a gold film (having a thickness of 10 μm and a width of about 0.3 mm) is formed on a transmission-line substrate 6 made of sintered alumina. Then, the strip conductor 5 is extended so as to protrude outward from the insulator substrate 6 and reach the inside of the shielding conductor 2. This extended portion is to be a coupling probe 8. Moreover, vises of M1.6 in the screw standard are used as frequency adjustment screws 14, 15 and an inter-stage coupling adjustment screw 16. An end portion of each of the vises is planarized and then the entire surface of each said vis is plated with gold.

Figure 22:
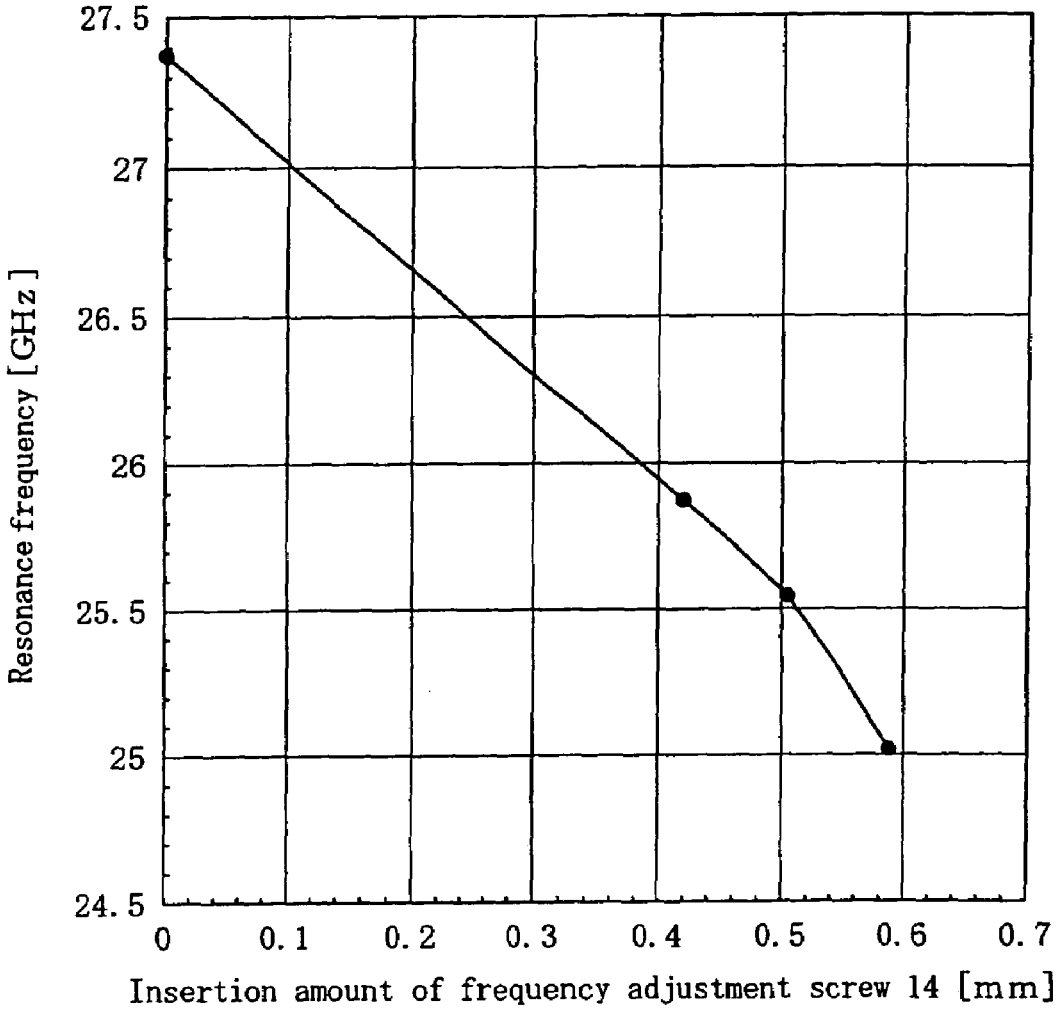
FIG. 22 is a graph showing the relation between the resonance frequency and the insertion amount of a frequency adjustment screw 14 of the high-frequency circuit device according to a specific example of the twelfth embodiment.
Figure 23:
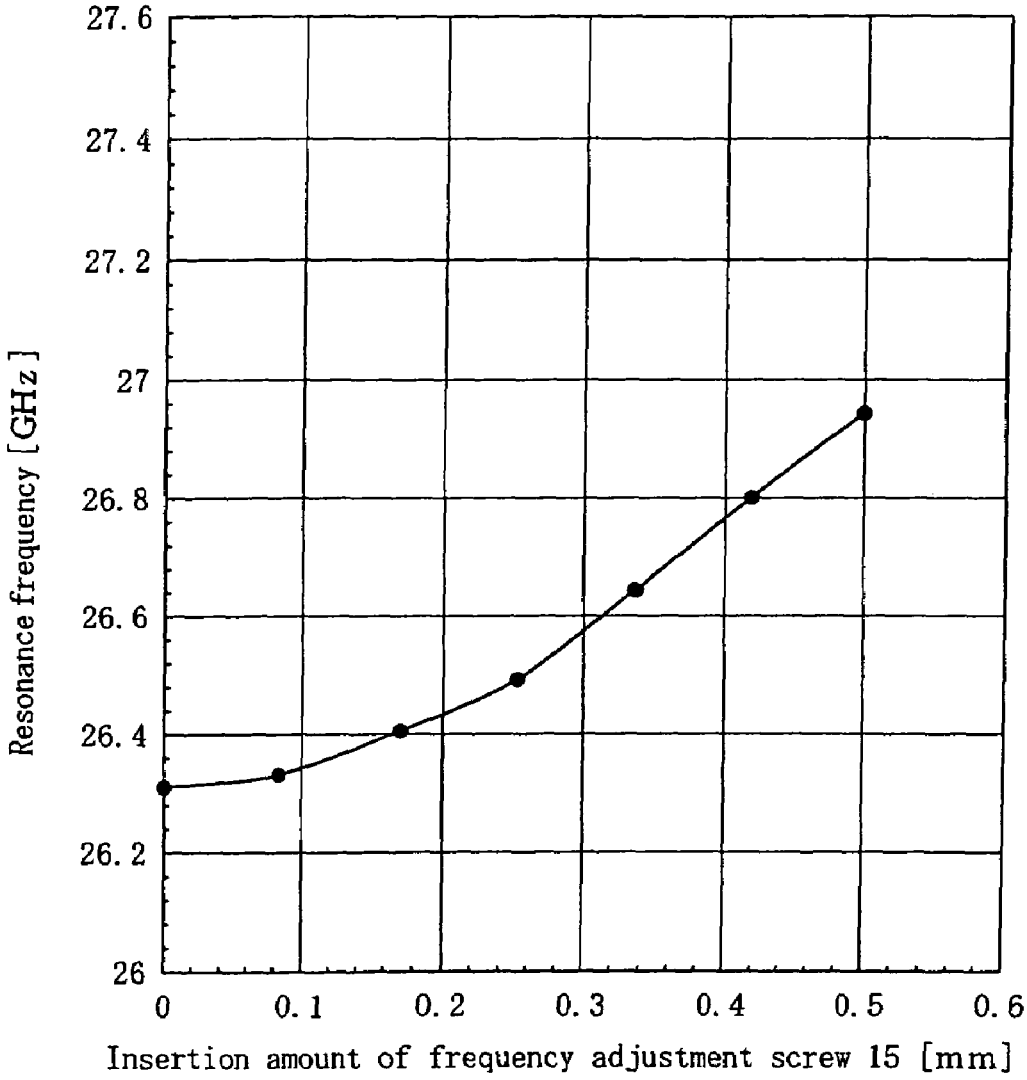
FIG. 23 is a graph showing the relation between the resonance frequency and the insertion amount of a frequency adjustment screw 15 of the high-frequency circuit device of the specific example of the twelfth embodiment.
Figure 24:
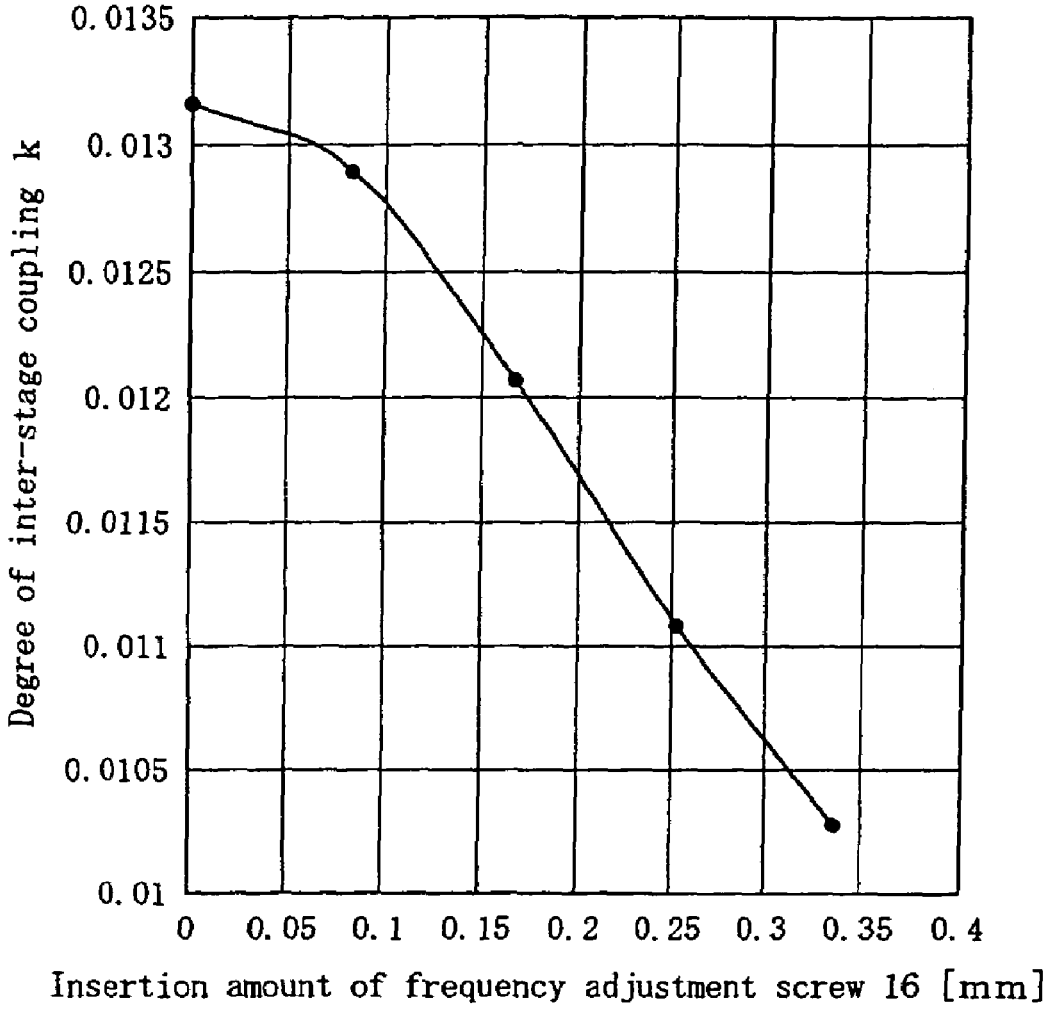
FIG. 24 is a graph showing the relation between the resonance frequency and the insertion amount of an inter-stage coupling adjustment screw 16 of the high-frequency circuit device of the specific example of the twelfth embodiment.

FIGS. 22 through 24 are graphs showing results of analysis using a network analyzer for describing the resonance frequency adjustment function of the high-frequency circuit device of this specific example. FIG. 22 is a graph showing the relation between the resonance frequency and the insertion amount of a frequency adjustment screw 14 of the high-frequency circuit device of this specific example. FIG. 23 is a graph showing the relation between the resonance frequency and the insertion amount of a frequency adjustment screw 15 of the high-frequency circuit device of this specific example. FIG. 24 is a graph showing the relation between the resonance frequency and the insertion amount of an inter-stage coupling adjustment screw 16 of the high-frequency circuit device of this specific example.

As can be seen from FIGS. 22 through 24, it is possible to finely adjust the resonance frequency and the degree of an inter-stage coupling by changing the insertion amount of each of the screws.

THIRTEENTH EMBODIMENT

Figure 25A:
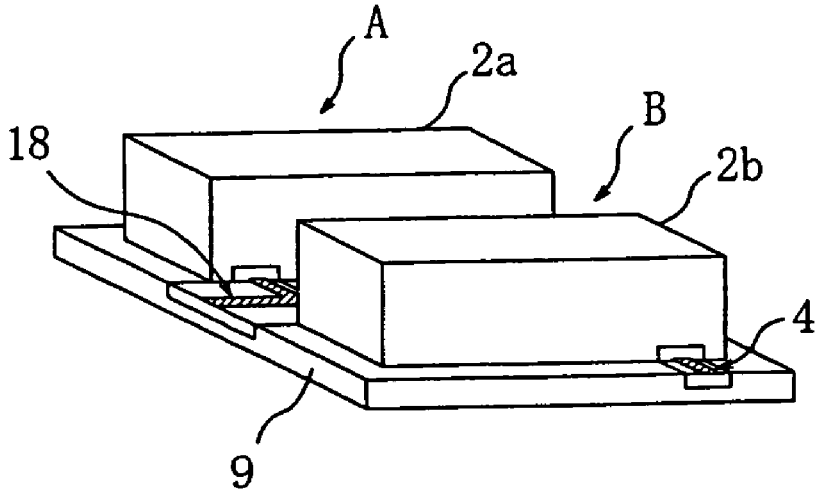
FIGS. 25(*a*) and 25(*b*) are perspective and cross-sectional views of a high-frequency circuit module according to a thirteenth embodiment of the present invention, respectively.
Figure 25B:
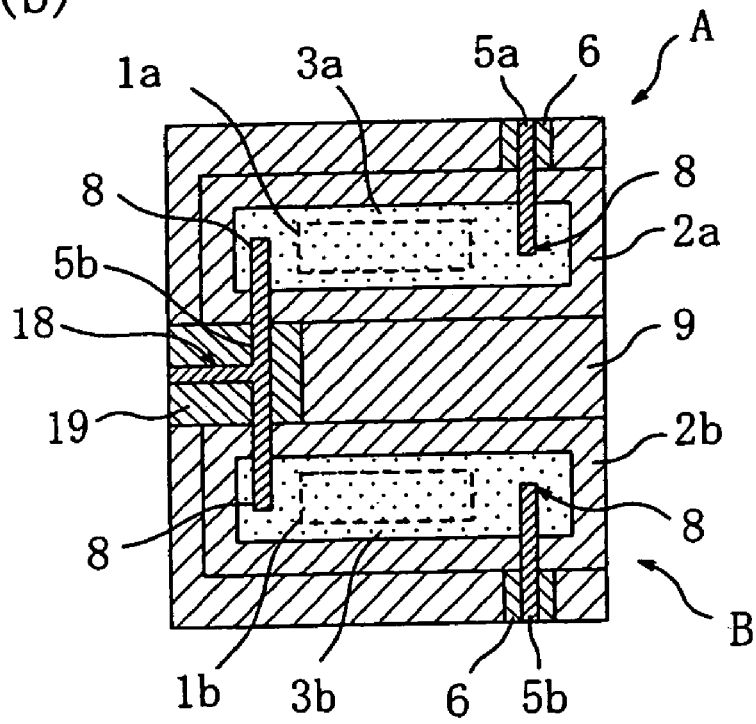

FIGS. 25($a$) and 25($b$) are perspective and cross-sectional views of a high-frequency circuit module according to a thirteenth embodiment of the present invention, respectively. In this embodiment, the high-frequency circuit module has a structure in which two high-frequency circuit devices of the first embodiment are combined with a phase shift circuit interposed therebetween. More specifically, each of two high-frequency circuit devices A and B having different center frequencies are input/output coupled with an associated one of two branch portions of a phase shift circuit 18 having an appropriate phase shift amount to form a common apparatus for separating signals having difference frequencies. The phase shift circuit 18 is a microstrip-line including an earth conductor layer 9, a phase shift circuit board 19 buried in a recess portion of the earth conductor layer 9, and a strip conductor 5$b$ formed of a metal film on the phase shift substrate 19. A main portion of the strip conductor 5$b$ is connected to an antenna. The basic structure for other parts is basically the same as that of the high-frequency circuit device of the first embodiment shown in FIGS. 1($a$) through 1($c$). The structure allows, for example, transmission of a high-frequency signal from the high-frequency circuit device B (or A) to an external circuit and reception of a high-frequency signal from an external circuit to the high-frequency circuit device B (or A) via the antenna.

Note that each of the high-frequency circuit devices is connected to a processing circuit by a switch. Signal processing such as signal amplification or signal transformation into a sound or image signal is performed in the processing circuit.

In the high-frequency circuit module of this embodiment, a plurality of the high-frequency circuit devices are provided with the phase shift circuit interposed therebetween. In other words, a small-size, low-loss common apparatus (which multiplexes or separates transmission/reception signals having different frequencies) can be achieved. Thus, functions which have been achieved with a known waveguide or the like can be attained on a circuit board.

For example, when a phase shift circuit is connected to an antenna, a signal can be transmitted or received. More specifically, when two high-frequency circuit devices having different center frequencies are combined with a phase shift circuit interposed therebetween, the effects of the first embodiment are maintained and also signals can be simultaneously transmitted and received.

Note that in this embodiment, as an exemplary common apparatus, a single-stage to single-stage type common apparatus has been described. However, if a plurality of dielectric members are used in at least one of the bandpass filters (i.e., the high-frequency circuit devices A and B), it is effective to utilize the common apparatus of this embodiment as a common apparatus including a multi-stage band filter.

SPECIFIC EXAMPLE OF THIRTEEN EMBODIMENT

Figure 26A:
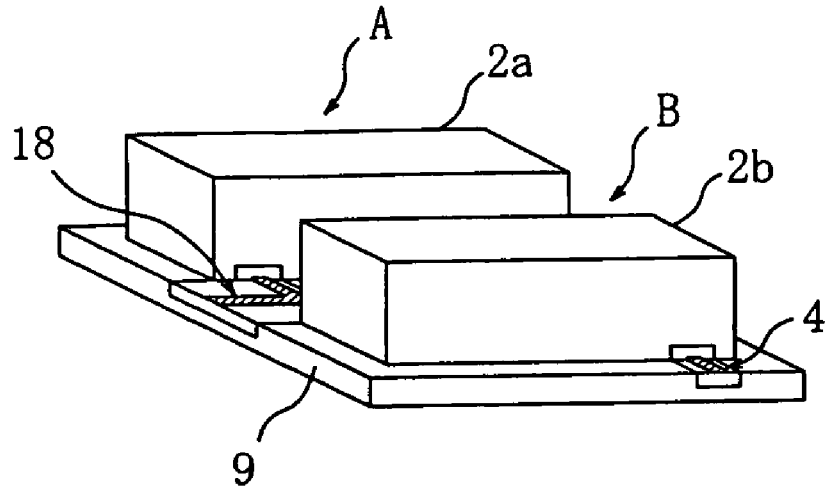
FIGS. 26(*a*) and 26(*b*) are perspective and cross-sectional views of a high-frequency circuit module according to a modified example of the thirteenth embodiment, respectively.
Figure 26B:
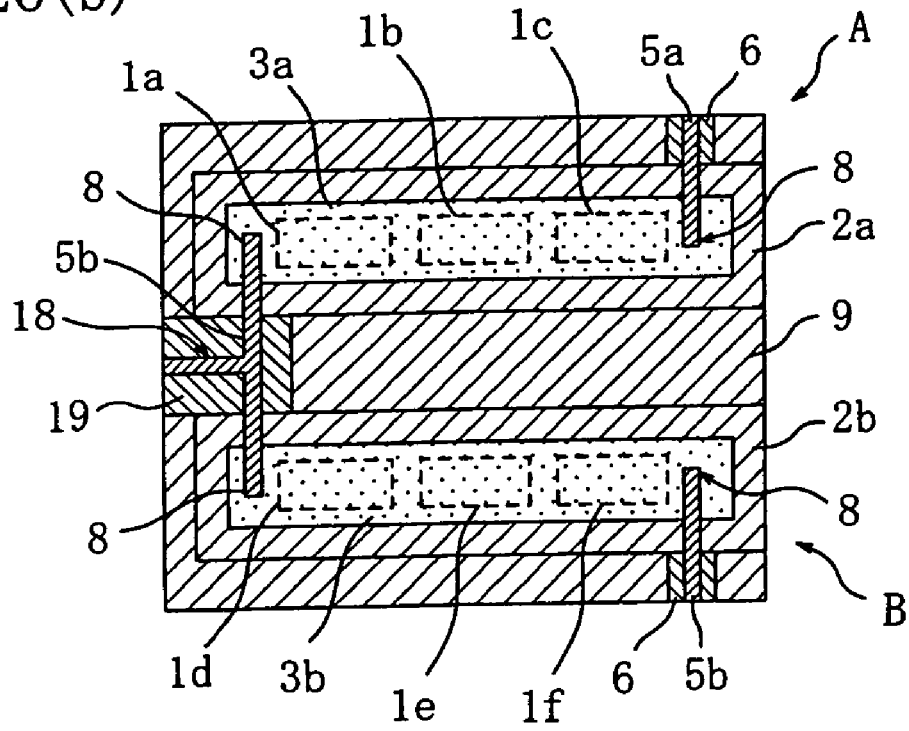

FIGS. 26(*a*) and 26(*b*) are perspective and cross-sectional views of a high-frequency circuit module according to a modified example of the thirteenth embodiment, respectively. In this modified embodiment, three dielectric members 1*a* through 1*c* are disposed in series in the longitudinal direction so as to be located at the same height in a high-frequency circuit device A, and three dielectric members 1*d* through 1*f* are disposed in series in the longitudinal direction so as to be located at the same height in a high-frequency circuit device B.

A high-frequency circuit module having the structure shown in FIGS. 26(*a*) and 26(*b*) has been formed in the following manner. In the high-frequency circuit device A (bandpass filter), two dielectric ceramic square poles (having a relative dielectric constant of 21 and a fQ value of 70000 GHz), as dielectric members 1*a*, 1*c*, each of which has dimensions of 1×1×5.6 mm, and a dielectric ceramic square pole (having a relative dielectric constant of 21 and a fQ value of 70000 GHz), as a dielectric member 1*b*, which has dimensions of 1×1×5.4 mm, are prepared. Then, the dielectric members 1*a* through 1*c* are fixed in a shielding conductor 2*a* formed of a zinc-copper alloy and having inside walls plated with gold. The dimensions of inside of the shielding conductor 2*a* is 3×3×24.1 mm.

Also, in the high-frequency circuit device B (bandpass filter), two dielectric ceramic square poles (having a relative dielectric constant of 21 and a fQ value of 70000 GHz), as dielectric members 1*d*, 1*f*, each of which has dimensions of 1×1×5.8 mm, and a dielectric ceramic square pole (having a relative dielectric constant of 21 and a fQ value of 70000 GHz), as a dielectric member 1*e*, which has dimensions of 1×1×5.6 mm are prepared. Then, the dielectric members 1*d* through 1*f* are fixed in a shielding conductor 2*b* formed of a zinc-copper alloy and having inside walls plated with gold. The dimensions of the inside of the shielding conductor 2*b* is 3×3×25.7 mm.

Then, polytetrafluoroethylene resin is used as support members 3*a*, 3*b* to be filled in the space between the shielding conductor 2*a* and each of the dielectric members 1*a* through 1*c* and the space between the shielding conductor 2*b* and each of the dielectric members 1*d* through 1*f*, respectively. As for transmission lines 4, strip conductors 5*a*, 5*c* (having a characteristic impedance of 50Ω) of a gold film (having a thickness of 10 μm and a width of about 0.3 mm) are formed on a transmission-line substrate 6 made of sintered alumina. Then, the strip conductors 5*a*, 5*c* are extended so as to protrude outward from the insulator substrate 6 and reach the insides of the shielding conductors 2*a*, 2*b*, respectively. These extended portions are to be coupling probes 8.

Moreover, as for a phase shift circuit 18, the strip conductor 5*b* made into a certain pattern is formed on a phase shift circuit board 19 formed of a polytetrapluoroethylene resin substrate. More specifically, the phase shift circuit 18 is made into a T shape pattern formed by a main portion and two branch portions. The width of the strip conductor 5*b* is set to be 0.5 mm so that the characteristic impedance of the circuit is around 50 Ω.

Note that the phase shift circuit 18 has the functions of separating and multiplexing signals by appropriately setting the length of each of the strip conductors to make the cross-band of each of the branch portions substantially in an electrically open state.

Figure 27A:
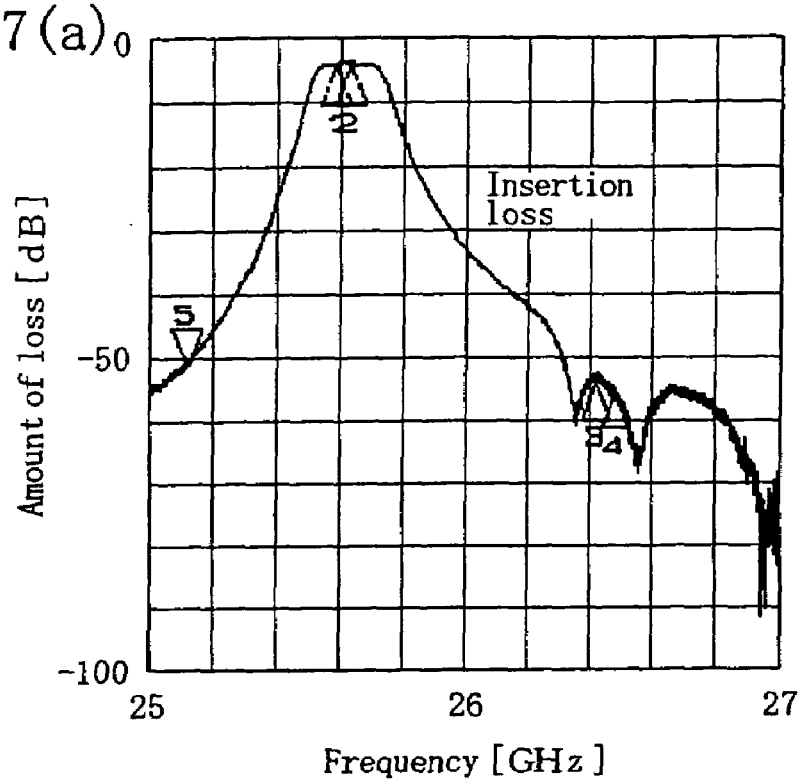
FIGS. 27(*a*) and 27(*b*) are graphs showing frequency characteristics with respect to insertion loss for a sender and a receiver of a signal, respectively.
Figure 27B:
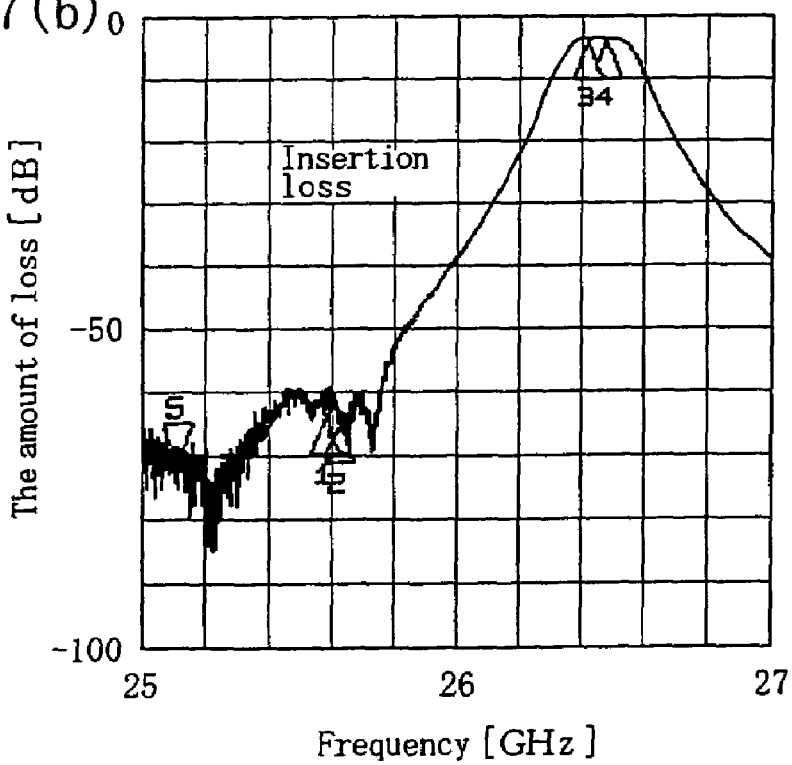

FIGS. 27(*a*) and 27(*b*) are graphs showing frequency characteristics with respect to insertion loss for a sender and a receiver of a signal, respectively. As can be seen from FIGS. 27(*a*) and 27(*b*), the high-frequency circuit module of this embodiment can finely operate as a three-stage to three-stage type common apparatus. The insertion loss of a signal was about 2 dB and the attenuation of the signal in the cross-band was from about 53 dB to 55 dB.

Moreover, in this structure, transmission lines 4 can be disposed in series with the dielectric members 1*a*, 1*b* in the longitudinal direction of the dielectric members 1*a*, 1*b* as shown in FIG. 1 of the first embodiment.

Figure 28A:
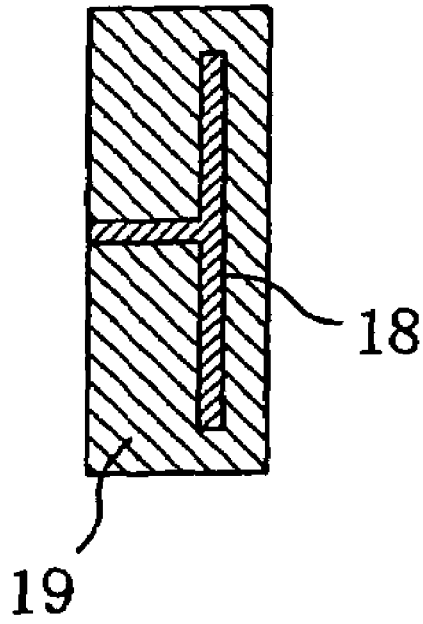
FIGS. 28(*a*) and 28(*b*) are cross-sectional view illustrating preferable structural examples for a phase shift circuit according to the thirteenth embodiment and the modified example of the thirteenth embodiment, respectively.
Figure 28B:
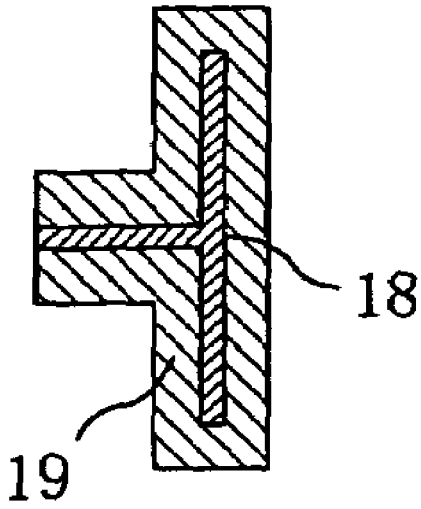

FIGS. 28(*a*) and 28(*b*) are cross-sectional views of a preferable structural example of the phase shift circuit in the thirteenth embodiment and the modified example. As shown in FIGS. 28(*a*) and 28(*b*), the transmission lines 4 and the phase shift circuits 18 of the high-frequency circuit devices A, B (bandpass filters) are unified on the phase shift circuit board 19, and thus reflection due to mismatching which normally occurs in a connected portion can be eliminated.

Moreover, in this embodiment, as an exemplary common apparatus, the common apparatus which multiplexes or separates transmission/reception signals in two frequency bands has been described. However, the high-frequency circuit module of the present invention is not limited to the structure of this embodiment but is also effective in the case where signals in three or more frequency bands are multiplexed or separated. In such a case, as the pattern of the phase shift circuit 18 on the phase shift circuit board 19, a pattern having as many branch portions as the number of frequency bands of signals to be multiplexed or separated may be used. If the number of branches is too many, it is effective to use a branched pattern in which a plurality of two-branch lines as shown in FIGS. 28(*a*) and 28(*b*) are combined and an edge of each branch is joined to a similar branch line. In either one of the cases, the amount of a phase shift (electric length) from a branch portion to each filter (high-frequency circuit device) is adjusted, and thereby the high-frequency circuit module can operate as a common apparatus.

OTHER EMBODIMENTS

In each of the above-described embodiments, the dielectric square pole with a rectangular cross section of the $TM_{11\delta}$ mode is used for the dielectric member 1. However, the present invention is not necessary limited to the structure. Even when a dielectric circular cylinder with a circular cross section is used, the same effects as those of each of the embodiments can be attained. It is a common practice to call a resonator mode in this case "$TM_{01\delta}$ mode". Moreover, the shape of a dielectric member's cross section has been described by taking as an example a dielectric member with a uniform cross section along their length direction, i.e., along the direction in which the electric field inside of the dielectric member extends. However, even if the shape of cross section of the dielectric member is partially changed, the present invention is also effective.

Figures 29, 30:
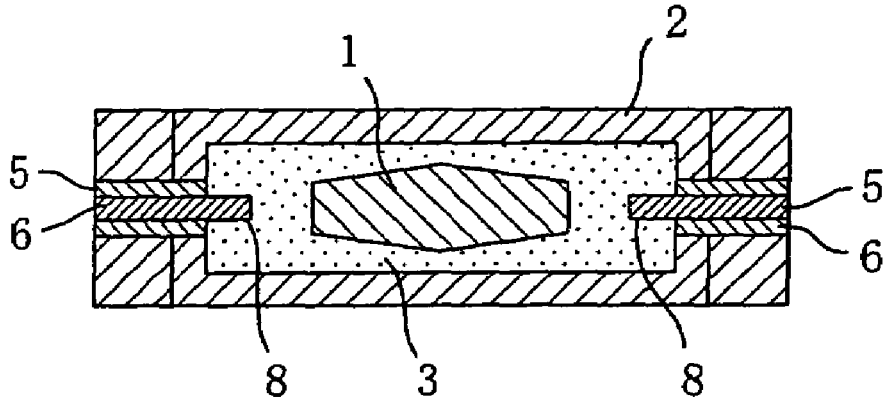
FIG. 29 is a cross-sectional view illustrating a modified example of the first embodiment in which the dielectric member 1 is formed so that the closer to a center portion of the dielectric member 1 a cross section thereof is, the larger a cross-sectional area becomes.
FIG. 30 is a table showing the respective sizes of a dielectric member and a shielding conductor at 26 GHz and actually measured no-load Q values for three types of ceramic materials.

FIG. 29 is a cross-sectional view illustrating a modified example of the first embodiment in which the dielectric member 1 is formed so that the closer to a center portion of the dielectric member a cross section thereof is, the larger a cross-sectional area becomes. In this manner, if the dimension of the cross section around the center portion of the dielectric member 1 is increased, the length of the dielectric member (resonator) can be reduced. The reason for this is that the intensity of the TM mode electric field is maximum around the center of the dielectric member, and therefore the effective dielectric constant of the resonator mode is increased by enlarging the area around the center of the dielectric member. This shape for a dielectric member is applicable to the second through thirteenth embodiments (including the modified examples).

Moreover, in the specific example of each of the embodiments except for the thirteenth embodiment, the dielectric member 1 is formed of a material containing $ZrO_2$—$TiO_2$—$MgNb_2O_6$ as a main component (having a relative dielectric constant of 42.2 and a fQ value of 43000 GHz). However, a material for the dielectric member 1 is not necessarily limited to the material. When a material having a higher dielectric constant than that of the support member 3 is used as the dielectric member 1, the $TM_{11\delta}$ mode appears and thus the effects of this embodiment can be reliably attained.

Moreover, the Q value of a resonator is largely influenced by dielectric loss of a material forming the dielectric member 1. Therefore, it is preferable to use as the dielectric material a low-loss material (i.e., a material having a large fQ value). Furthermore, if a material having a high dielectric constant is used, the dielectric member 1 may have a small length and a small diameter to obtain the same resonance frequency. Therefore, the size of resonators can be reduced.

FIG. 30 is a table showing the respective sizes of a dielectric member and a shielding conductor at 26 GHz and actually measured no-load Q values for three types of ceramic materials.

As the dielectric member 1, a material, such as alumina, having a small dielectric constant and low loss is used, the size of a resonator is increased but a large no-load Q value for the resonator can be obtained.

As the support member 3 of each of the specific examples, polytetrafluoroethylene whose relative dielectric constant is 2 is used as an example. However, a material for the support member 3 is not necessarily limited to polytetrafluoroethylene, but other materials which can support and fix the dielectric member 1 may be used. However, the dielectric constant of the support member 3 is preferably lower than that of the dielectric member 1. Actually, assume that a dielectric member having a relative dielectric constant of 20 or more is used as the dielectric member 1. If a material having a relative dielectric constant of 15 or less is used as the support member 3, more preferable properties can be achieved.

Moreover, in each of the embodiments except for the ninth embodiment, the structure in which the support member 3 is filled in spaces in the shielding conductor 2 has been described. However, the structure of a support member for supporting a dielectric member of the present invention is not necessarily limited to the structure, but the structure of the support member for supporting a dielectric member of the ninth embodiment may be applied to the other embodiments.

Moreover, a duplexer for separating transmission/reception signals having different frequencies can be formed by connecting the bandpass filter and the band stop filter (notch filter) which have been described in each of the embodiments by a branch line formed of a microstrip-line or the like. In this case, a duplexer can be obtained by input/output coupling each of two bandpass filters, one of which has its center frequency around its transmission frequency, and the other of which has its center frequency around its reception frequency, with a branch portion of a branch transmission line having an appropriate phase shift amount. Furthermore, in order to satisfy desired specifications, band stop filter can be connected with the bandpass filter in series and thereby the attenuation in the cross-band can be increased.

Moreover, in each of the above-described embodiments, the case in which the 26 GHz band is a designed frequency band has been described as an example. However, the frequency band does not have to be the 26 GHz band. If the dimensions of the dielectric member are changed according to a desired frequency, the present invention is applicable in a wide frequency range. Specifically, if a material having a relative dielectric constant of about 20–40 is used for a resonator, the width of the resonator is in a range from 0.1 mm to 10 mm in a frequency range from about 5 GHz to 100 GHz. Thus, the high-frequency circuit device has an appropriate size, and therefore this is convenient where the structure of the present invention is used. More specifically, in a frequency range of 20–70 GHz, if the dielectric member is formed of a low-loss ceramic material of FIG. 30, it exhibits a higher no-load Q value than that of the dielectric member having a different structure. Also, the size of the high-frequency circuit device is small enough to be mounted on a circuit board and does not require a specifically precise processing. Therefore, very high effects of the present invention can be attained.

Furthermore, in each of the above-described embodiments, the two transmission lines 4 are provided on the common earth conductor layer 9. However, a transmission line of the high-frequency circuit device according to the present invention is not necessarily limited to this structure.

Figure 31A:
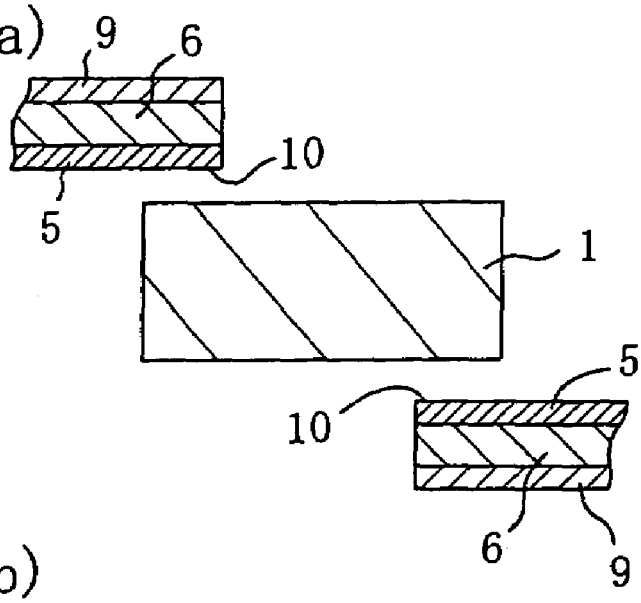
FIGS. 31(*a*), 31(*b*), and 31(*c*) are plane views illustrating a structural example of the high-frequency circuit device of the present invention in which a pair of transmission lines are provided on an earth conductor layer.
Figure 31B:
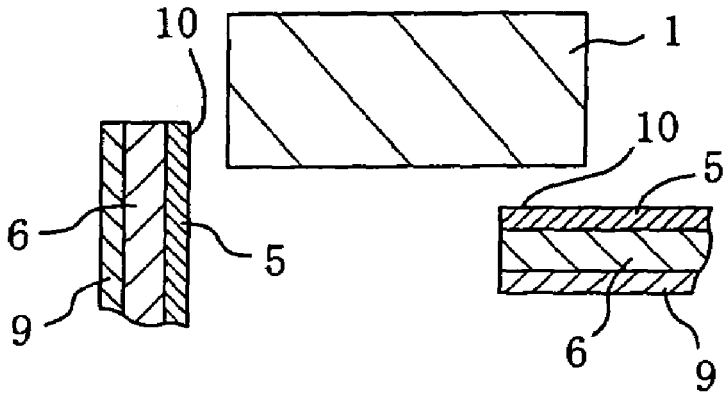
Figure 31C:
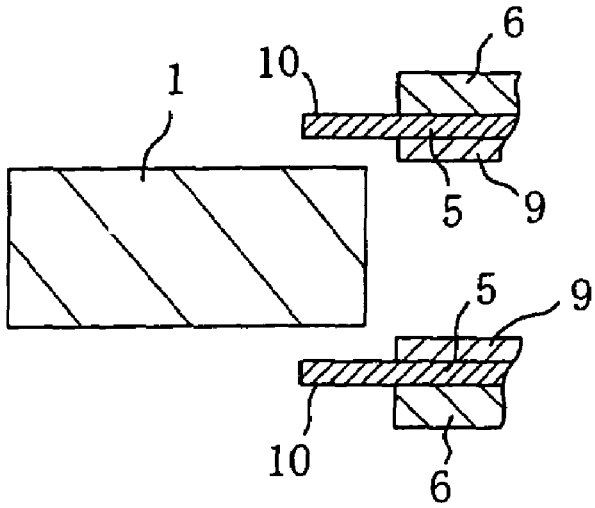

FIGS. 31(*a*), 31(*b*), and 31(*c*) are plane views illustrating an exemplary structure of the high-frequency circuit device of the present invention in which a pair of transmission lines are provided on an earth conductor layer. As shown in FIGS. 31(*a*) through 31(*c*), as long as a portion of the strip conductor which is to be a coupling probe 10 faces any part of the dielectric member 1, the input/output coupling function can be obtained and therefore basic effects of the present invention can be attained. Note that if a coplanar line is provided, the earth conductor layer 9 shown in FIGS. 31(*a*)

through 31(*c*) is formed on the same side of the transmission-line substrate 6 as the strip conductor 5 is located. Moreover, the transmission-line substrate 6 and the earth conductor layer 9 do not have to be provided in the portion of the strip conductor which serves as the coupling probe 10.

Moreover, in each of the above-described embodiments, the example in which a microstrip-line or a coplanar line is used for the transmission lines 4 has been described. However, the transmission lines 4 in the high-frequency circuit device or high-frequency circuit module of the present invention are not limited to the embodiments.

Figures 32A, 32B, 32C, 32D, 32E, 32F, 32G, 32H, 32I:
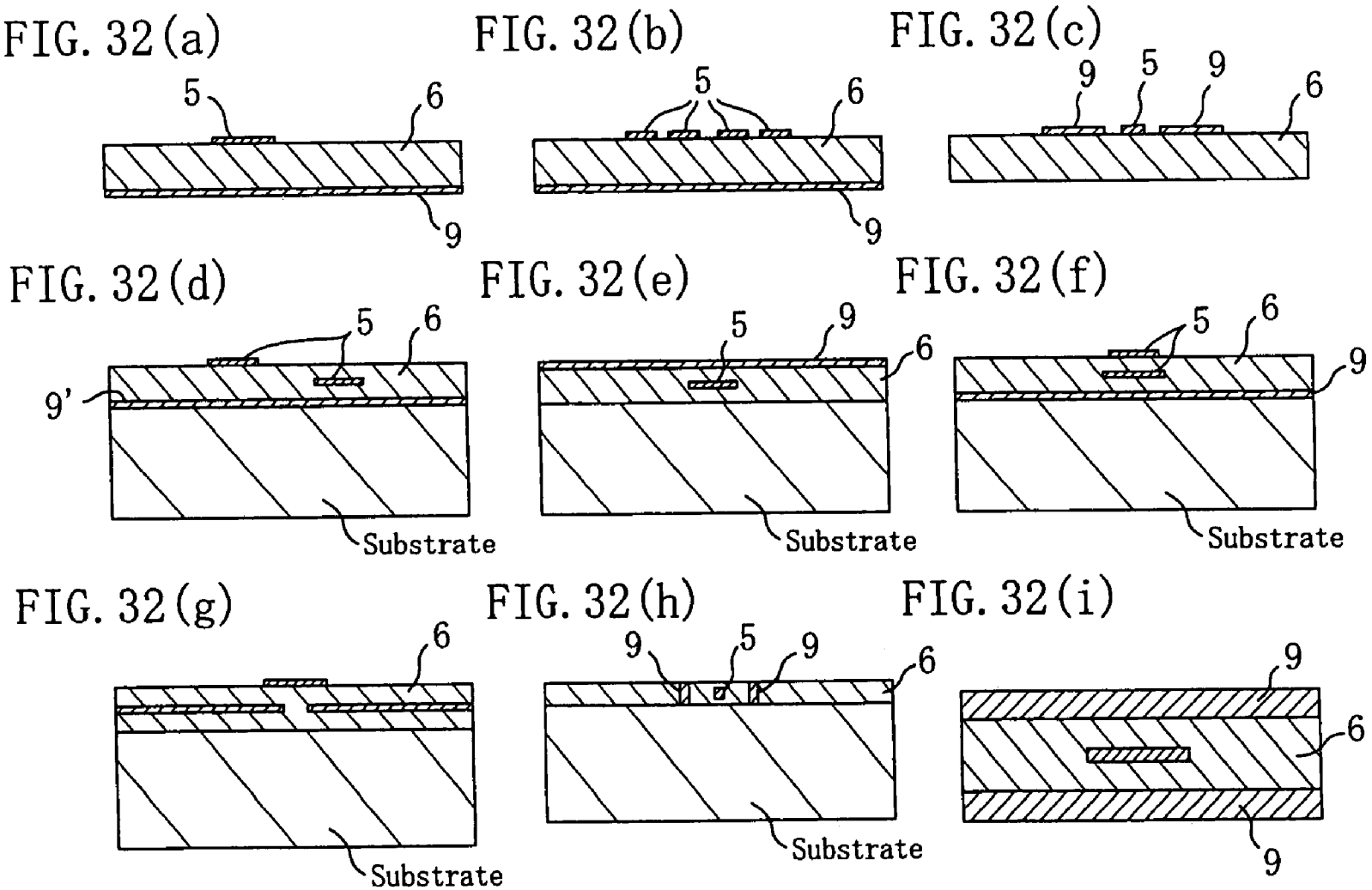
FIGS. 32(*a*) through 32(*i*) are cross-sectional views illustrating an exemplary transmission line applicable to the high-frequency circuit device or high-frequency circuit module of the present invention.

FIGS. 32(*a*) through 32(*i*) are cross-sectional views illustrating an exemplary transmission line applicable to the high-frequency circuit device or the high-frequency circuit module of the present invention. In FIGS. 32(*a*) through 32(*i*), the reference numeral 5 indicates an exemplary strip conductor, the reference numeral 6 indicates an exemplary transmission-line substrate, and the reference numeral 9 indicates an exemplary earth conductor layer, as in each of the embodiments. FIG. 32(*a*) shows an exemplary microstrip-line that is the most general one, FIG. 32(*b*) shows an exemplary multi-line microstrip-line, FIG. 32(*c*) shows an exemplary coplanar line, FIG. 32(*c*) also shows an exemplary TFMS (thin film microstrip) line, FIG. 32(*d*) shows an exemplary inverted TFMS line, FIG. 32(*e*) shows another exemplary inverted TFMS line, FIG. 32(*f*) shows an exemplary wide-area coupling TFMS line, FIG. 32(*g*) shows an exemplary TFMS line with a slit, FIG. 32(*h*) shows an exemplary microwire line, and FIG. 32(*i*) shows an exemplary stripline. The high-frequency circuit device or the high-frequency circuit module of the present invention may include a transmission line having any one of the structures of FIGS. 32(*a*) through 32(*i*) or a combination of several ones of the structures of FIGS. 32(*a*) through 32(*i*).

As has been described, if any one of the structures according to the present invention is used, a small size high-frequency circuit device which has a simplified structure and allows a resonant operation with a high Q value can be obtained. Specifically, if the present invention is applied to a resonant circuit such as a resonator or a filter in a millimeter wave band, higher effects of the present invention can be attained.

Furthermore, a high-frequency circuit module made by applying the high-frequency circuit device is formed utilizing the small size and high Q value characteristics of the high-frequency circuit device, and thus a small size, low-loss high-frequency circuit module which exhibit great functions can be obtained.

INDUSTRIAL APPLICABILITY

A high-frequency circuit device or a high-frequency circuit module according to the present invention is applicable to 1. A high-frequency circuit device of a signal transmitting/receiving apparatus in an FWA (fixed wireless access) system using a millimeter wave or a microwave
2. A high-frequency circuit portion of a terminal and a base station in a mobile communication system (e.g., cellular phone)
3. A circuit dealing with a high-frequency modulation signal in an optical communication system
4. A high-frequency circuit portion of a wireless LAN apparatus
5. A high-frequency circuit portion in an inter-vehicle or roadside-to-vehicle communication system
6. A high-frequency circuit portion in a millimeter wave radar system or the like.

The invention claimed is:

1. A high-frequency circuit module characterized in that the high-frequency circuit module includes:

a plurality of high-frequency circuit devices; and a phase shift circuit provided between adjacent ones of the plurality of high-frequency circuit devices;

each said high-frequency circuit device includes:

at least a dielectric member which can create a resonant state of an electromagnetic wave;

a support member which surrounds the dielectric member and has a lower dielectric constant than that of the dielectric member;

a shielding conductor surrounding the support member;

at least a transmission line including a strip conductor disposed to face part of the dielectric member, an earth conductor layer disposed to face the strip conductor, and a transmission-line substrate interposed between the strip conductor and the earth conductor layer; and a coupling probe which is connected to the transmission line and has the input/output coupling function of input/output coupling with the dielectric member by an electromagnetic wave, the dielectric member is excited in the $TM_{11\delta}$ mode when it has a rectangular cross section or in the $TM_{01\delta}$ mode when it has a circular cross section, and the transmission line of each said high-frequency circuit device is connected to the phase shift circuit.

2. The high-frequency circuit module of claim 1, characterized in that the respective center frequencies of the plurality of high-frequency circuit devices when each of them is in a resonant state are different to each other.

3. The high-frequency circuit module of claim 1, characterized in that the phase shift circuit is connected to an antenna.

* * * * *

UNITED STATES PATENT AND TRADEMARK OFFICE

CERTIFICATE OF CORRECTION

PATENT NO. : 7,057,483 B2
APPLICATION NO. : 11/186109
DATED : June 6, 2006
INVENTOR(S) : Akira Enokihara et al.

It is certified that error appears in the above-identified patent and that said Letters Patent is hereby corrected as shown below:

Title Page

Item (56), References Cited, Page 2, FOREIGN PATENT DOCUMENTS:

Delete "JP 02108001 A 8/1989"

Signed and Sealed this

Second Day of January, 2007

JON W. DUDAS
*Director of the United States Patent and Trademark Office*